US008245947B2

(12) United States Patent
Roderick et al.

(10) Patent No.: US 8,245,947 B2
(45) Date of Patent: Aug. 21, 2012

(54) THERMOGENIC AUGMENTATION SYSTEM

(75) Inventors: David Roderick, Hopland, CA (US); Myron Beigler, Woodside, CA (US)

(73) Assignee: David Roderick, Hopland, CA (US)

( * ) Notice: Subject to any disclaimer, the term of this patent is extended or adjusted under 35 U.S.C. 154(b) by 0 days.

(21) Appl. No.: 13/179,892

(22) Filed: Jul. 11, 2011

(65) Prior Publication Data

US 2012/0149291 A1 Jun. 14, 2012

Related U.S. Application Data

(63) Continuation-in-part of application No. 12/835,979, filed on Jul. 14, 2010, now Pat. No. 8,100,341.

(60) Provisional application No. 61/364,564, filed on Jul. 15, 2010, provisional application No. 61/226,722, filed on Jul. 19, 2009.

(51) Int. Cl.
*F24F 7/06* (2006.01)

(52) U.S. Cl. ..... 236/49.3; 454/186; 454/365; 454/366; 52/173.3; 52/198

(58) Field of Classification Search ..... 236/49.3; 454/185, 186, 365, 366, 367; 52/173.3, 198
See application file for complete search history.

(56) References Cited

U.S. PATENT DOCUMENTS

| | | | |
|---|---|---|---|
| 2,602,406 | A | 7/1952 | Orter |
| 3,476,032 | A | 11/1969 | Mattly |
| 3,660,955 | A | 5/1972 | Simon |
| 4,498,262 | A | 2/1985 | Garcia |
| 5,078,047 | A | 1/1992 | Wimberly |
| 5,487,247 | A | 1/1996 | Pigg |
| 6,061,978 | A | 5/2000 | Dinwoodie et al. |
| 6,220,956 | B1 | 4/2001 | Killian et al. |
| 6,780,099 | B1 | 8/2004 | Harper |
| 6,843,718 | B2 | 1/2005 | Schmitz |
| 6,869,661 | B1 | 3/2005 | Ahr |
| 7,618,310 | B2 | 11/2009 | Daniels |
| 7,818,922 | B2 | 10/2010 | Ellis |
| 2003/0126806 | A1 | 7/2003 | Ellis |

OTHER PUBLICATIONS

Maneewan et al., Heat gain reduction by means of thermoelectric roof solar collector, Solar Energy, 78 (2005) 495-503.
A laboratory Experiment on natural ventilation through a roof cavity for reduction of solar heat gain, Susanti et al., Energy and Building 40 (2008) 2196-2206.

(Continued)

*Primary Examiner* — Marc Norman

(57) ABSTRACT

A dual air cavity roof has a continuous upper cavity which is cooled by fans, while the lower cavity is generally sealed. Preferably the cavities are separated by a radiant barrier. The fans are preferably powered by one or more photovoltaic cells that are also disposed on the roof. The roof can be pre-cooled with cooler night air and fans only activated when necessary to remove heat from the solar load on the upper cavity. When it is desirable to remove heat, the fan speed is optimized in each zone of the roof to enhance the natural convective flow to the optimum level. A radiant barrier can also cover the roof substrate, which is optionally an existing roof that is in need of repair. The roof structure is preferably assembled in parallel modules using insulating support brackets that support the outer surface and the barrier that separates the upper and lower cavity.

20 Claims, 34 Drawing Sheets

OTHER PUBLICATIONS

Development and preliminary evaluation of double roof prototypes incorporating RBS (radiant barrier system), Chang et al., Energy and Building 40 (2008) 140-147.

A combined approach for determining the thermal performance of radiant barriers under field conditions, Miranville et al., Solar Energy 82 (2008) 399-410.

Optimal Spacing for Double Skin Roofs, Lai et al., Building and Environment 43 (2008) 1749-1754.

Heat transfer in a double-skin roof ventilated by natural convection in summer time, Biwole, et al., Energy and Building 40 (2008) 1487-1497.

Experimental Investigation on air heating and natural ventilation of a solar air collector, Zhai, et al., Energy and Building 37 (2005) 373-381.

Double Skin Facades, http://en.wikipedia.org/wiki/Double-skin_facade, Jul. 1, 2010.

Double Skin Facades, Roth et al., Ashrae Journal, p. 70 and 73, Oct. 2007.

Davis Energy Group, Nightbreeze™ Products Development Project, Prepared for California Energy Commission and dated Feb. 2007.

Davis Energy Group, Alternatives to Compressor Cooling, Phase V: Integrated Ventilation Cooling, California Energy Commission, dated Feb. 2004.

FIG. 9A
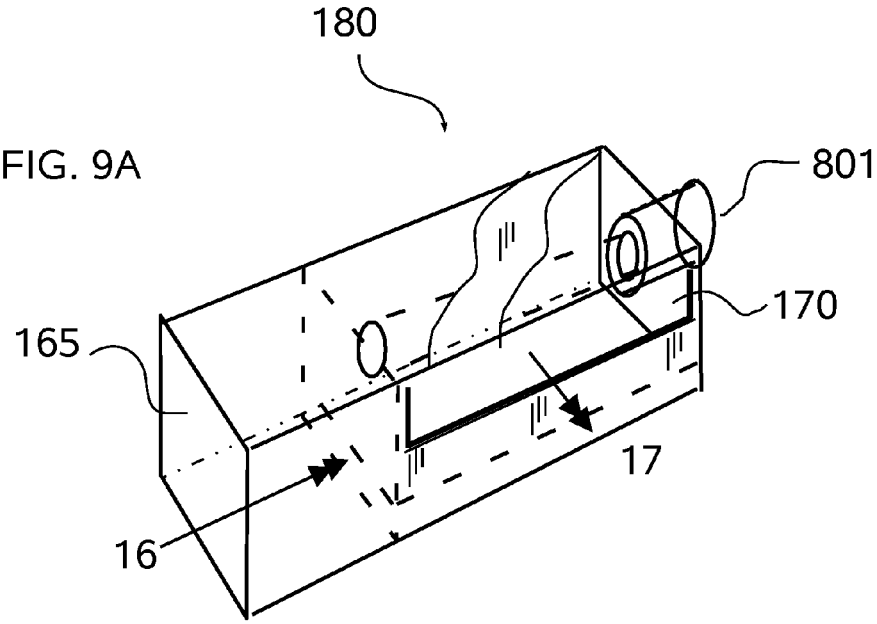
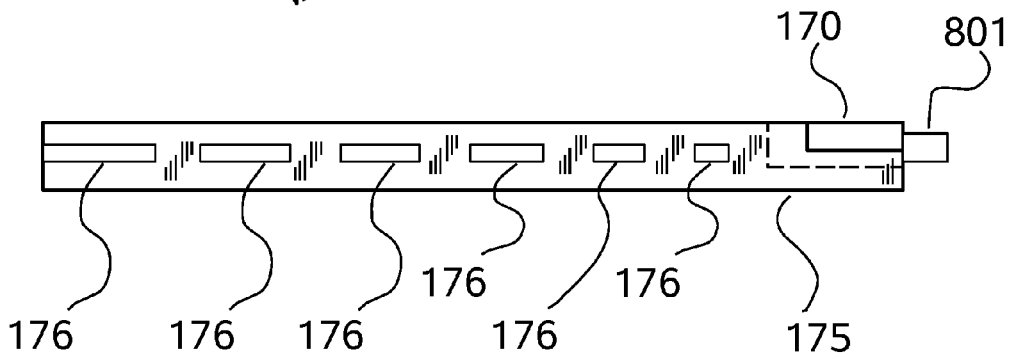
FIG. 9B

START
1901
Actuate temperature and wind speed sensors and clock
1902
Wind speed is greater than 6 mph?
1903
NO
YES
Actual date and/or time within parameters?
1904
YES
NO
Ambient air is below roof Temp.?
1905
YES
NO
Ambient air temp. is above attic temperature
1906
NO
YES
Fan(s) OFF
1907
Fan(s) ON
1908
Fan(s) operate in pulse mode
1909

| | 100 cfm | 2100 cfm |
|---|---|---|
| Single channel | | |
| Double channel | | |

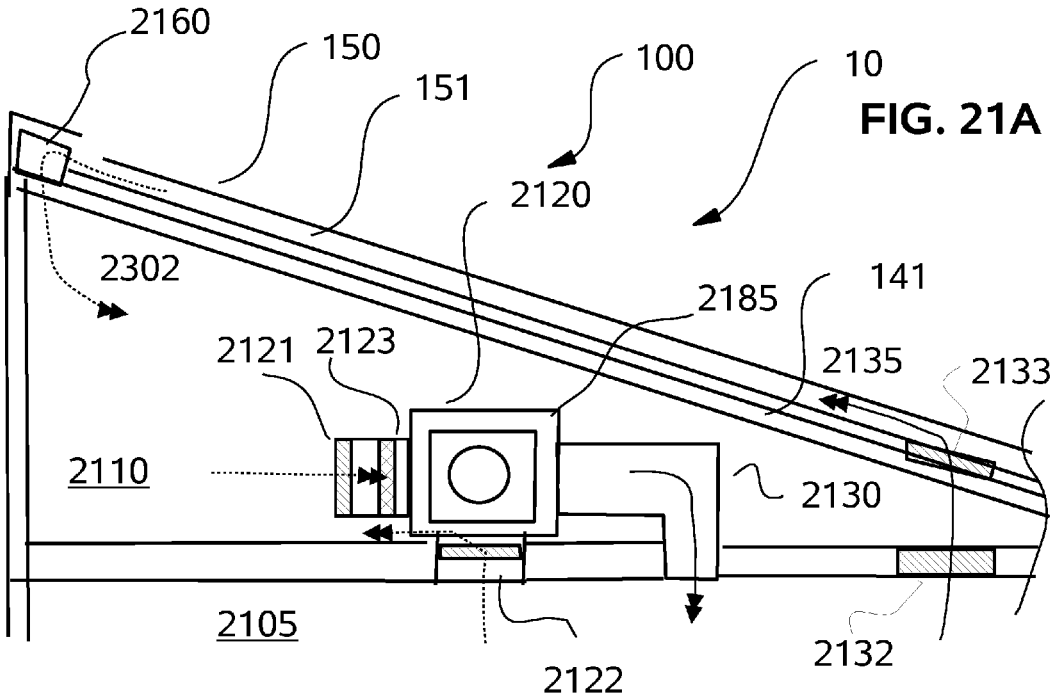
FIG. 21A
FIG. 21B
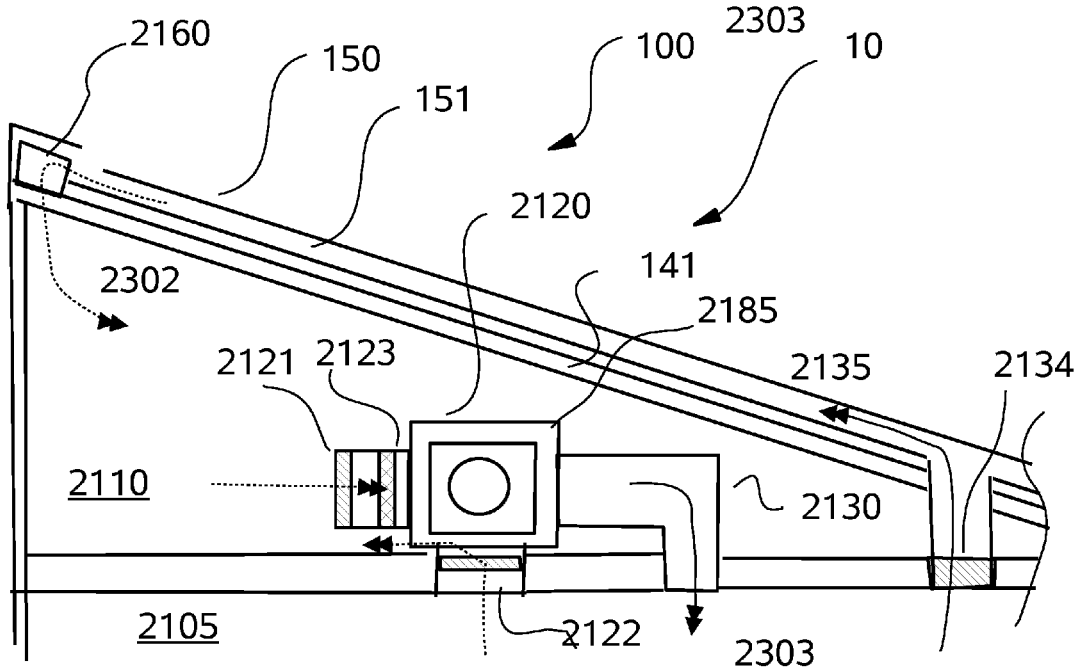

Shield ceiling temp.

Control ceiling temp.

Ambient temp.

THERMOGENIC AUGMENTATION SYSTEM

CROSS REFERENCE TO RELATED APPLICATIONS

The present application claims the benefit of priority to the U.S. Provisional Patent Application of the same title that was filed on Jul. 15, 2010, having application Ser. No. 61/364,564, and is incorporated herein by reference.

The present application is also a Continuation-in-Part of and claims the benefit of priority to the U.S. Non-Provisional Patent Application for a "Solar Power Augmented Heat Shield Systems" that was filed on Jul. 14, 2010, having application Ser. No. 12/835,979, and is incorporated herein by reference, which in turn claims the benefit of priority to the U.S. Provisional Patent Application for a "Solar Power Augmented Heat Shield Systems" that was filed on Jul. 19, 2009, having application Ser. No. 61/226,722, and is incorporated herein by reference.

BACKGROUND OF INVENTION

The present invention relates to a method of cooling and heating buildings and structures that does not require direct external energy sources.

In warm sunny climates, air conditioning or other mechanical means for cooling dwellings, office buildings and any other structure that needs to be maintained below a critical temperature consumes significant energy, places high stress on the electrical power infrastructure and increases harmful emissions of carbon dioxide and other greenhouse gases, depending on the sources of power.

While there are alternative technologies for generating power without producing carbon dioxide and other greenhouse gases, they constitute only a small fraction of the total electrical power produced worldwide. Further, it is expected that such sources of power will grow slowly, and require significant capital investments to replace fossil fueled power plants. Currently, there are few alternative energy systems devoted to cooling structures.

Accordingly, it would be of great benefit to provide a means of reducing the need for electric power, and in particular, in climates where power is needed for cooling buildings using standard air conditioning technology.

It is therefore a first object of the present invention to provide a means for cooling buildings and structures without using additional power.

It is a further object of the invention to reduce electrical or other power consumption used to cool buildings or structures to desired temperature ranges using less air conditioning or other mechanical cooling systems.

It is a further object of the invention to reduce electrical or other power consumption/generation and the associated carbon emissions.

SUMMARY OF INVENTION

In the present invention, the first object is achieved by a providing a thermogenic augmentation system disposed on the exterior surface of a building structure, the system comprising: radiant barrier layer covering at least one exterior surface of the structure, the radiant barrier layer being generally disposed in a first plane that is co-extensive with a planar portion of the structure, a plurality of mounting brackets disposed above said radiant barrier that are connected to the exterior surface of the structure, wherein said mounting brackets support; an inner skin spaced away from said radiant barrier layer, being disposed in a second plane substantially parallel to said first plane, an outer skin spaced away from said inner skin, being disposed in a third plane substantially parallel to said first plane and second plane, wherein the region between said radiant barrier layer and the inner skin is a lower cavity, and the region between said inner skin and said outer skin is a ventilated upper cavity, one or more air inlet vents disposed in fluid communication with the upper cavity at the lower lateral extent thereof, one or more air outlet vents disposed in fluid communication with the upper cavity at the upper lateral extent thereof, at least one fan disposed in fluid communication with the upper cavity to expel the air out from said air outlet vents, wherein the expelled air is selectably vented to the attic or ventilation system of the structure or external to the structure, a means to direct air from the upper cavity to the attic space, a means to force the air received in the attic space into the ventilation system of the building structure, and a means for air to return to the attic space of the building structure from the portion of the structure that received air from the ventilation system thereof.

Another object of the invention is achieved by providing thermogenic augmentation system disposed on the exterior surface of a building structure, the system comprising: a radiant barrier layer covering at least one exterior surface of the structure, the radiant barrier layer being generally disposed in a first plane that is co-extensive with a planar portion of the structure, a plurality of mounting brackets disposed above said radiant barrier that are connected to the exterior surface of the structure, wherein said mounting brackets support; an outer skin spaced away from said radiant barrier layer, being disposed in a second plane substantially parallel to said first plane to form an outer cavity, one or more air inlet vents disposed in fluid communication with the outer cavity at the lower lateral extent thereof, one or more air outlet vents disposed in fluid communication with the outer cavity at the upper lateral extent thereof, at least one fan disposed in fluid communication with the outer cavity to draw air in from said air inlet vents and then expel the air out from said air outlet vents, wherein the expelled air is selectably vented to at least one of the attic, the ventilation system of the structure and external to the structure.

Further objects of the invention are achieved when the thermogenic augmentation system has a means to direct air from the upper cavity to the attic space that comprises a duct that extends the length of a roof having said upper cavity and said means for air to return to the dwelling is at least one fan.

Further objects of the invention are achieved when the thermogenic augmentation system further comprises a plurality of heat transfer coils disposed within said duct.

Further objects of the invention are achieved when the thermogenic augmentation system when said fan is disposed in fluid communication with the center of the duct and said heat transfer coils are subdivided into 2 pairs disposed on opposing sides of said fan.

Further objects of the invention are achieved when the thermogenic augmentation system further comprising a baffle means that is operative to selectively expel air from the duct after passing over said heat transfer coils and before entering said attic space.

Further objects of the invention are achieved when the thermogenic augmentation system when said baffle means are disposed between said duct and said fan such that hot air can escape and be directed upward without entering the air space when said fan is not operating.

Further objects of the invention are achieved when the thermogenic augmentation system further comprises an air mixing unit having an intake fan means that is disposed in the attic and is in fluid communication with the attic air space to collect air inserted therein for return to a dwelling portion of the building structure via a primary ventilation duct, the primary ventilation duct being in fluid communication with at least one of an air conditioner and a forced air heater.

Further objects of the invention are achieved when the thermogenic augmentation system further comprises an adjustable baffle means to isolate at least one of an air conditioner and forced air heater when the intake fan means of the air mixing unit is operative to force air from the attic space into the dwelling via said primary ventilation duct.

Further objects of the invention are achieved when the thermogenic augmentation system further comprises a plurality of PV cells disposed on the outer surface of the structure to receive solar radiation and connected provide power to said at least one fan.

Further objects of the invention are achieved when the thermogenic augmentation system further comprises a plurality of thermal sensors disposed to measure and compare the temperatures in different portions of the system.

Further objects of the invention are achieved when the thermogenic augmentation system further comprises comprising a controller that is operative to modulate the operation of the said fans in response to measured differences in temperatures.

Further objects of the invention are achieved when the thermogenic augmentation system wherein the outer skin is the roof of the structure.

The above and other objects, effects, features, and advantages of the present invention will become more apparent from the following description of the embodiments thereof taken in conjunction with the accompanying drawings.

BRIEF DESCRIPTION OF THE DRAWINGS

FIG. 6A is a cross-sectional elevation of a bracket deployed in the embodiment of FIG. 5, whereas

FIG. 7A is a perspective view of another bracket, whereas

FIG. 8A is a cross-sectional elevation of the heat shield system using the bracket shown in FIG. 7A-D, whereas

FIG. 9A is perspective view of the cross-flow fan that is optionally deployed in the embodiments shown in FIGS. 1, 2, 10, 12, 13 and 15, whereas FIG. 9B is an elevation view of the associated baffle separating the duct and upper cavity.

FIG. 21A and 21B are cross-sectional elevations of additional alternative embodiments of the system in which the attic space is optionally in selective fluid communication with at least one of the upper and lower cavity.

FIG. 23A-C illustrate the potential night time air flow for the embodiment of FIG. 21, wherein FIG. 23A is a cross-sectional elevation of a portion of the system, FIG. 23B is an elevation view of the duct and FIG. 23C is a cross-sectional elevation of the duct that is taken orthogonal to the view in FIG. 23A

DETAILED DESCRIPTION

Figures 1A, 1B, 1C:
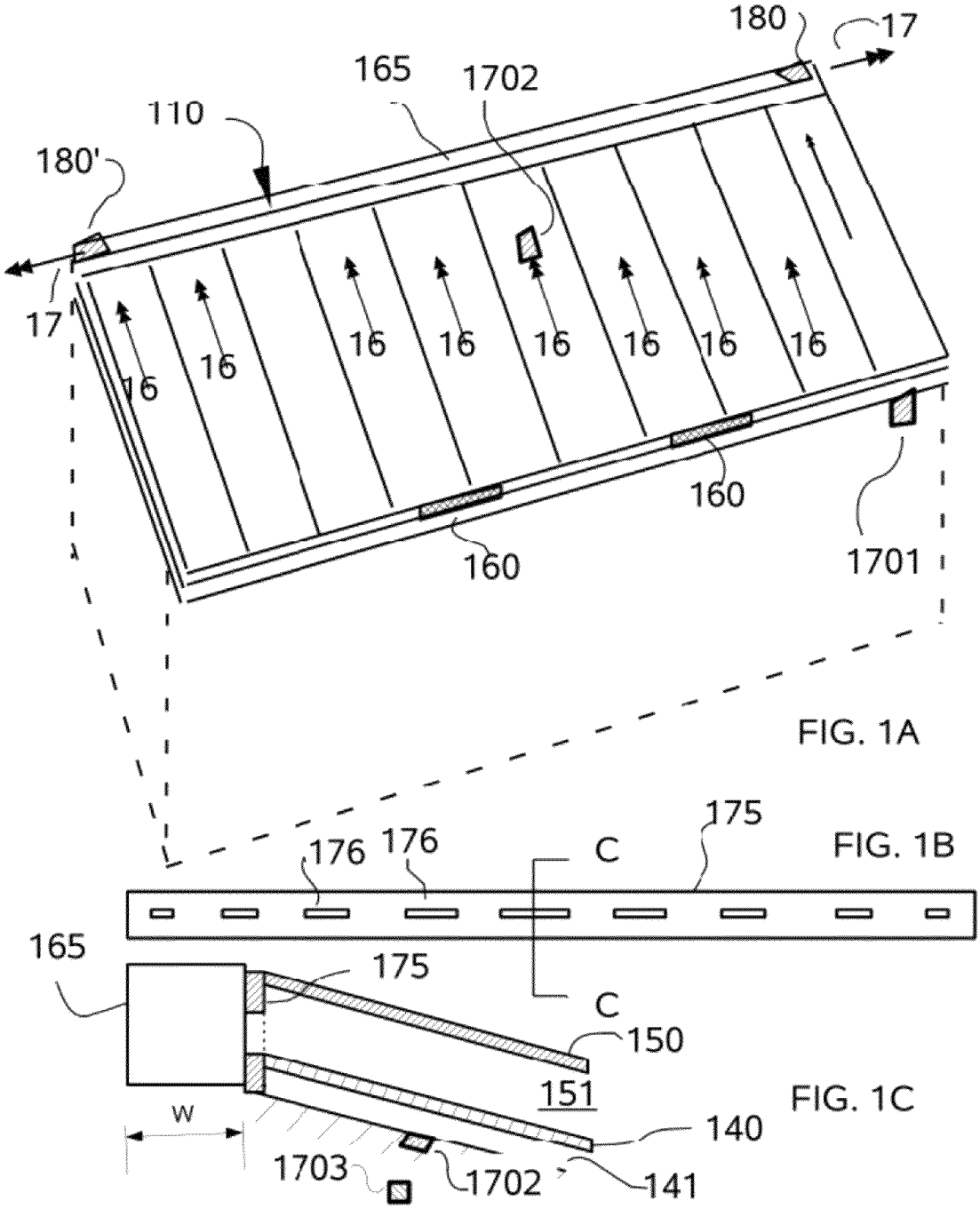
FIG. 1A is a perspective view of a first embodiment of the invention showing the exterior and roof of a building structure having the inventive heat shield system deployed on the roof thereof.
FIG. 1B is an elevation view of a baffle component deployed between an internal duct of the heat shield system shown in FIG. 1A.
FIG. 1C is a cross-sectional elevation of the duct, baffle and heat shield system shown in FIG. 1B.
Figure 2:
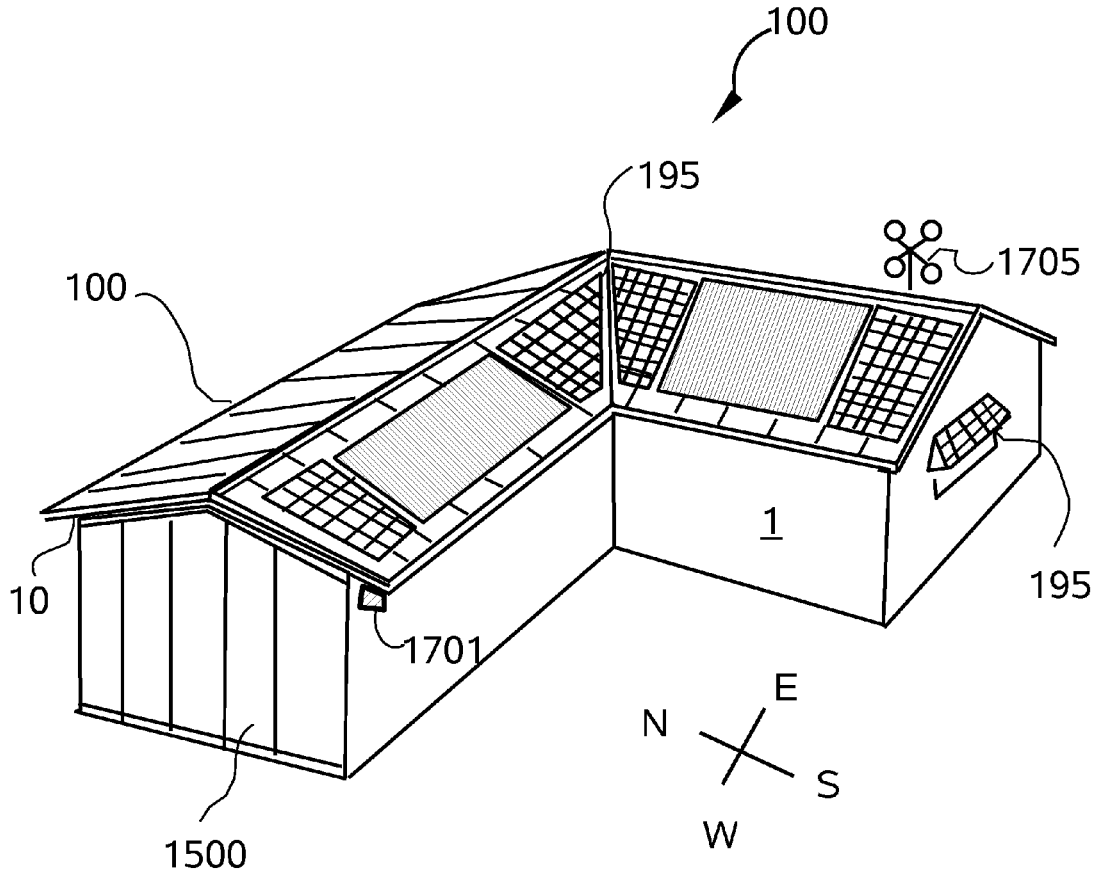
FIG. 2 is a perspective view of another embodiment of the invention showing the exterior and roof of a building structure deploying the inventive heat shield system on the roof and west facing wall, along with other preferred components of the heat shield system.

Referring to FIGS. 1 through 33, wherein like reference numerals refer to like components in the various views, there is illustrated therein a new thermogenic augmentation system, generally denominated 100 herein.

In accordance with the present invention the active solar heat shield and roof system 100 is deployed on a pitched or shed roof, but can alternatively be deployed on any structure or enclosure with a sealed roof surface or a vertical wall, as well as smaller structures, such as utility cabinets, storage sheds and shipping containers, and outdoor metal or plastic toilets.

FIGS. 1-4 illustrate a first embodiment in which the passive solar heat shield 100 is deployed on a pitched roof 1; and a variant thereof 1500 is deployed on a west facing (but optionally any wall) vertical wall surface. The active solar heat shield and roof system 100 is deployed on a building structure 1 having a roof or wall frame 10 and generally comprises a radiant barrier cover or layer 120 over at least one wall or roof frame of the structure 10. Mounting brackets 130 are disposed over the radiant barrier cover 120 to support the outer roof or shield layer 150 and inner roof layer 140 to define a dual skin roof 110. The inner layer 140 of the dual skin roof 110 extents substantially laterally the full extent of the roof or wall surface 10 and is air spaced off the radiant barrier 120 by the mounting bracket 130, to provide an inner cavity 141. The preferred mounting brackets also support an outer layer 150 of the dual roof skin 110, which also extends substantially the full lateral extent of the roof or wall surface provide an upper cavity 151 between the outer or shield layer 150 and the inner layer 140.

Thus, as the structure is heated by sun exposure and ambient air, the dual roof 110 provides a channel 151 for convective flow of higher temperature air to areas of low ambient air temperatures, exploiting the natural convective phenomena, such that the fan 180 assists in initiating and maintaining the convective cooling air flow in the upper cavity 151. The inner layer 141 is preferably sealed and acts as an additional insulating layer from the structure.

A radiant barrier layer 120 (see FIG. 4) is typically a thin thermal insulator surrounded or coated with low emissivity materials such as a metal, as for example a metal laminated foam resin, or quilted polymeric fiber, such as polyester or polymeric foam core type insulation bonded to reflective metalized plastic film or polished aluminum on both sides, as for example "ESP Low-E"® insulation which has a polyethylene core and polished aluminum or facing, which is available from Environmentally Safe Products Inc., of New Oxford, Pa.

Air vents 160 are provided in fluid communication with the upper cavity 151 to allow external air to enter. Preferably the air vents 160 (FIG. 11) are screened and extend continuously along the edge of the roof. Additionally, air outlets 170 are provided in fluid communication with the upper cavity 151 to allow this external air to flow from the air vents 160 and then exit cavity 151. The flowing air in cavity 151 after draws heat from outer layer 150 and inner layer 140. Further, at least one fan 180 in fluid communication with the upper cavity 151 to draw air in from the air vents 160 and dispel the heated air at outlets 170. The fan(s) 180 are thus operative to enhance the natural upward convective air flow out of the upper cavity 151, but in other embodiments may be selectively activated to pre-cool the roof system 100, depending on the time of day and the external temperature. Further, the inventive system in the most preferred embodiment includes various means 190 (see FIG. 17) to power the fans 180.

The outer roof surface 150 ideally reflects a high percentage of ambient solar or infrared (IR) energy, decreasing the incident infrared energy on the structure and the resulting solar heat gain on the building surface, and thus increasing the total solar reflectance (TSR) of the structure. The solar powered cross-flow ventilation fan 180 creates a moving air current heat-barrier, somewhat insulating the inner layer 140. The inner layer 140, via cavity 141 provides further thermal insulation to the underlying roof 10 and structure 1, thus largely preventing collateral heat gain from excess radiant heat from the outer layer 150.

Outer roof layer 150 in this embodiment is preferably a 24 gauge metal standing-seam roof or shield member. This outer roof 150 provides water and weather poof protection to the lower layers and the building structure 1. A preferred base material for the construction of the outer roof layer 150 is 55% Aluminum-Zinc alloy coated sheet steel, of which a well known commercial brand is "GALVALUME"™. Similar metal sheeting for outer layer 150 would also preferably have a high emissivity coating to provide a high Solar Roof Index (SRI). The SRI is calculated as specified in ASTM E 1980 and is a scale of 1 to 100 that is a measure of a roof's combined thermal properties. It is defined so that a standard black (reflectance 0.05, remittance 0.90) is 0 and a standard white (reflectance 0.80, remittance 0.90) is 100. Most preferably, the coating is a white thermoplastic or other white roof coatings having an SRI value as high as 104 to 110. For examples, one such coating that can be metal sheeting is CERAM-A-STAR 950® CC Series® by Akzo Nobel Coatings Inc. which is a silicone modified polyester (SMP) combined with ceramic and inorganic pigments, which is available in various grades and can have a solar reflectivity of about 0.72 and a solar emissivity of about 0.84. CERAM-A-STAR and other such coatings are available in colors other than white, but still retain high infrared emissivity, as the fillers or pigments in the coating absorb primarily visible light. As an alternative to metal the dual roof outer layer or skin 150 can be fiberboard with scrim radiant facing.

In the more preferred embodiment show fans 180 and 180' are disposed at opposite sides of the roof at the ridge to receive air from a common duct 165 disposed below outer roof layer 150 and running along the ridge between these fans 180 and 180'. A baffle 175 is disposed between the common duct 165 and the upper cavity 151. Baffle 175 has a series of apertures 176 that vary in open area, preferably via a variation in width across the horizontal expanse thereof. The variation in the aperture size allows for uniform air flow distal and proximal to the fans 180 and 180' across the width of the outer cavity 151, which is illustrated via double headed arrows 16 showing the direction of air flow from the air vents 160 toward the common duct 165. Duct 165 preferably has a square cross-section as shown in FIG. 1C, with sides having a width, W, of about 4.75", which is the same height of the baffle 175. Double headed arrows 17 show the direction of air flow exiting the duct 165 via fans 180 at air outlets 170. The motor 801 and all electrical connection to the sensors and controllers and PV-cells 195, described further below, are preferably in a waterproof housing. As shown in FIG. 1, the air vents 160 for the pitched roof are preferably screened eave vents 160.

It should also be appreciated that louvers or fins may be deployed in the space between the radiant barrier cover and dual roof skin to promote laminar air flow in upper cavity 151. In a more preferred embodiment air vents 160 are closable on the screening side to preclude wind damage or offer additional protection from fires, as well as for winter thermal isolation.

Figure 3:
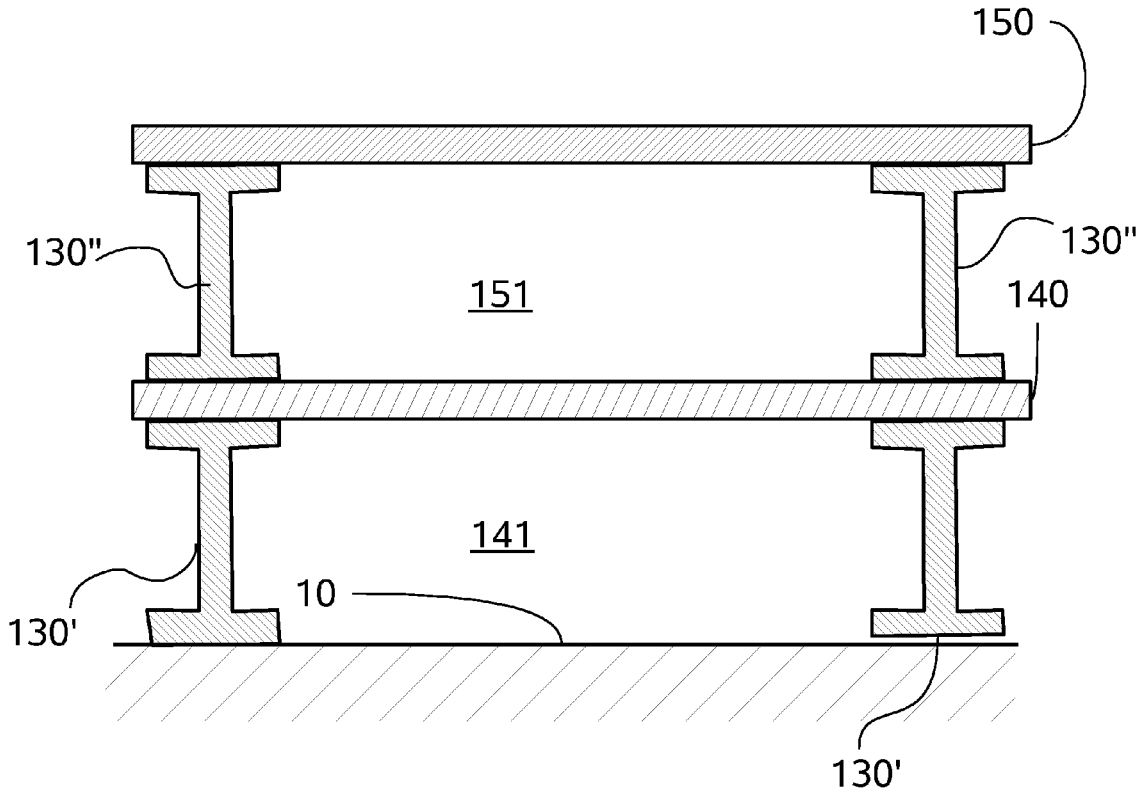
FIG. 3 is a schematic cross-sectional elevation of an embodiment of the general roof structure of the inventive heat shield system.
Figure 4:
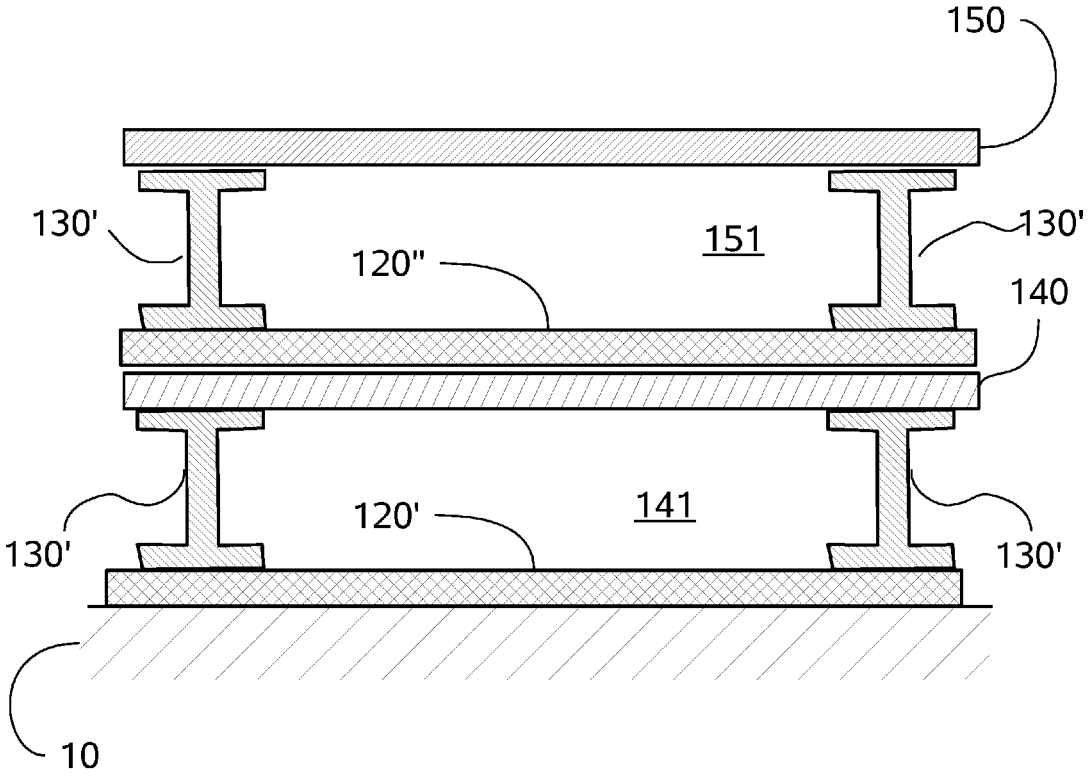
FIG. 4 is a schematic cross-sectional elevation of a preferred embodiment of the general roof structure of the inventive heat shield system.

A simple form of a bracket for supporting roof layers 140 and/or 150 is an I-beam 130 shown in FIGS. 3 and 4 in which sets of lower I-beams 130' space inner layer 140 of the surface of the roof 100, and upper I-beams 130" then space the outer layer 150 off of the inner layer 140 to define the upper cavity 151.

FIG. 4 shows a more preferred embodiment in which a first radiant barrier layer 120' is disposed on the roof inner surface 10, which is either a prior roof left in place, or plywood sheathing 11 (see FIG. 5) disposed on rafters or roof support beams 12. The inner layer 140 supports a second radiant barrier layer 120". More preferably, brackets 130 are a material with a low thermal conductivity, such as for example plastic or composite or reinforced polymer resin brackets, are preferred over metal brackets. Alternative non-metallic supports or brackets include extruded fiber reinforced engineering plastics) or steel or aluminum supports with thermal isolating layers at horizontal connecting faces.

Figure 5:
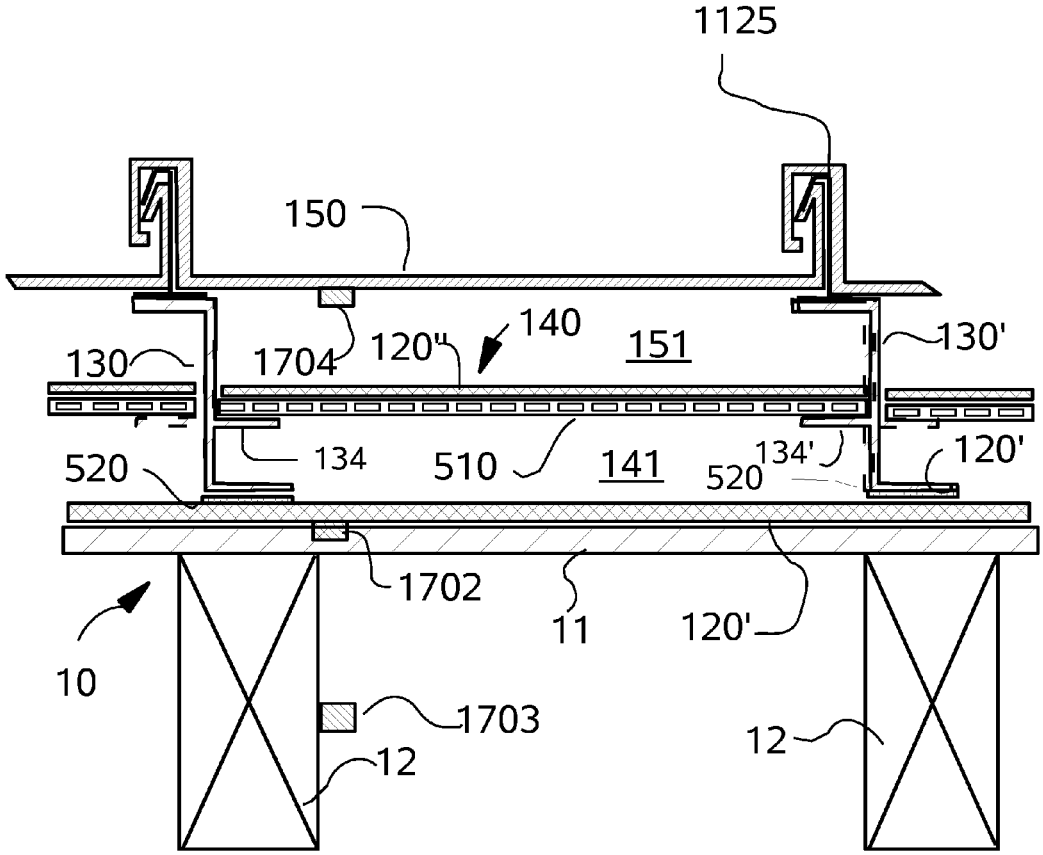
FIG. 5 is a cross-sectional elevation illustrating additional components in a more preferred implementation of the embodiment of FIG. 4.

FIG. 5 illustrates another preferred embodiment for brackets 130 and the inner layer 140. In this configuration the first radiant barrier 120' is disposed on the plywood sheathing 11 that is supporting by roofing rafters 12. Ideally, the radiant barrier 120' provides thermal insulation between brackets 130 and the attached horizontal member of the dual roof structure to minimize thermal conduction via brackets 130. It is further preferable that the brackets 130 are a material of low thermal conductivity, such as plastic or polymeric resin, or includes the optional thermal block or isolating member 520 between it and the radiant barrier layer 120'. More preferably, one or more additional thermal block or isolating members 520 would be provided where the bracket 130 connects to the outer layer 150.

In this more preferred embodiment a thermoplastic resin support panel 510 is disposed above surface 10 by brackets 130 and is in turn covered by a second radiant barrier layer 120" to form inner layer 140. Currently preferred embodiments of such thermoplastic resin panels are "COROCEL™" brand expanded high density polyvinyl sheets as well as "COROPLAST™" brand extruded twin wall plastic sheets based on high impact polypropylene copolymer, both available from Coroplast, East Dallas, Tex.

It will be appreciated from other preferred embodiments that the radiant barrier layer 120" can also provide the physical barrier to air flow between cavities 141 and 151, with member 140 acting as a physical support. Thus the radiant barrier layer 120" and any member that provides it with lateral support can be considered the inner layer 140.

Figure 6A:
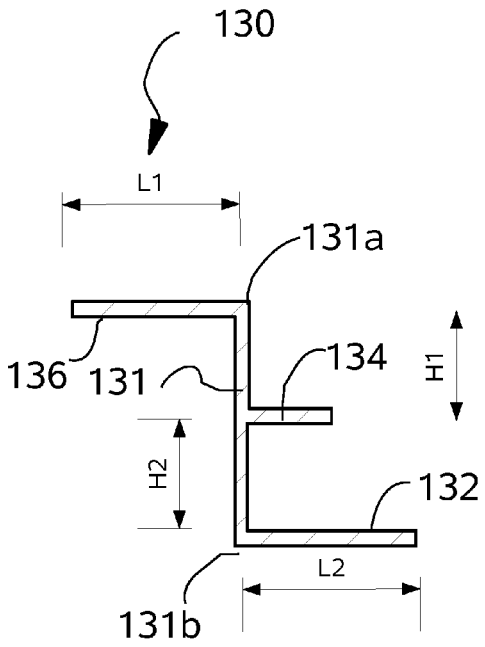
Figure 6B:
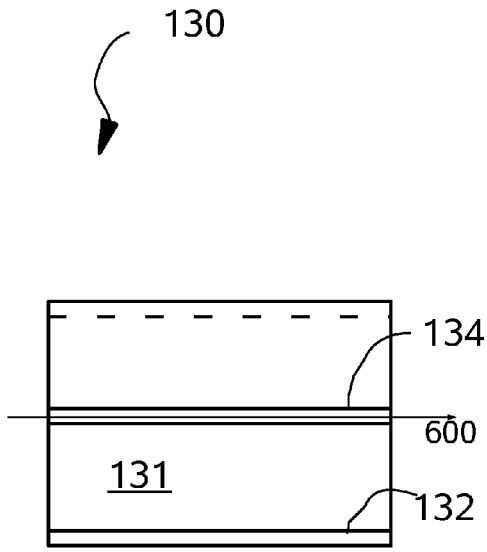
FIG. 6B is an orthogonal exterior elevation of the same bracket.

FIG. 5 also illustrates the preferred use of fewer brackets, and in particular the installation of a single set of brackets 130 on the roof surface 10 that then supports both the inner layer 140 and the outer layer 150. Various embodiments of such more preferred bracket 130 are shown in FIGS. 6-8. Bracket 130 when viewed in cross-section in FIG. 6A has a single vertical portion 131 and three additional portions extending horizontally therefrom. A lower horizontal portion or foot 132 of length L2 is for mounting to the roof surface 10, while an upper horizontal portion 136 of length L1 is for receiving in supporting engagement the outer roofing structure 150, using conventional fastener means. The lower horizontal foot 132 preferably has holes or apertures for receiving fasteners such as screws and nails for attachment or existing roof structures 10, plywood sheathing 11 or framing 12. The upper horizontal portion 136 extends horizontally from the top 131*a* of the vertical portion 131, but preferably in the opposite direction of the lower horizontal foot 132, and does not interfere with the attachment of the lower fastener. Between the upper and lower horizontal feet is at least one intermediate horizontal member 134 that is separated from these feet by heights H1 and H2 respectively. Preferably H1 and H2 are both about 1.5 in., whereas L1 and L2 are about 3 in. There is at least one intermediate horizontal member 134 that preferably extends only about half the distance L2, or about 1.5 in. to not interfere with the roof fastening process and is intended to support the inner layer 140 that divides the space between the roof surface 10 and the outer roof layer 150 into the upper cavity 151 and the lower cavity 141. The outer roof 150 is thus mounted on the adjacent upper horizontal portion 136 and 136' of brackets 130 and 130' respectively, as shown in FIG. 5. Thus, when brackets 130 and 130' are deployed as pairs, their respective intermediate horizontal members 134 and 134' face each other to support the components that form the inner layer 140.

Thus, a preferred bracket 130 is symmetric in that L1 equals L2 and H1 equals H2 so that the same bracket 130 in FIG. 5 can be rotated about its principal axis 600 by 180° to provide the brackets 130 and 130' shown on the left and right side of FIG. 5. The brackets 130 and 130' are then ideally staggered along the fall line of the roof so that the adjacent thermoplastic resin support panels 510 are supported on both sides.

As the outer cavity 151 and inner cavity 141 have a thickness corresponding to dimension H1 and H2 of bracket 130, if it is desired to provide a different cavity spacing to optimize thermal efficiency for some environments then right and left handed version of brackets 130 with support arm 134 extending in opposite directions can be deployed in pairs to provide a different H1 and H2.

Figure 7B:
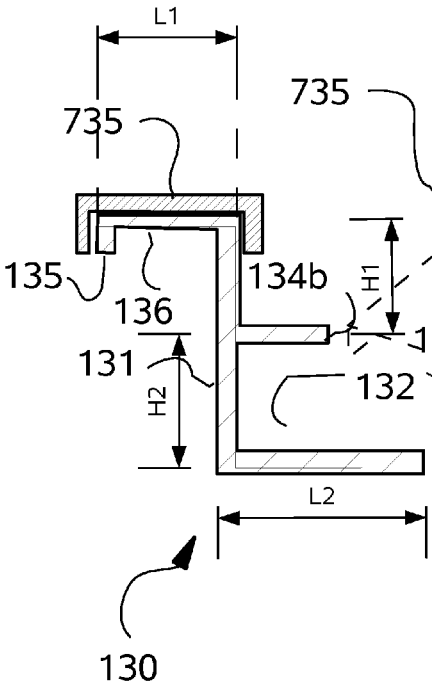
FIG. 7B is a side cross-sectional elevation thereof that includes an associated intermediate mounting member.
Figure 7A:
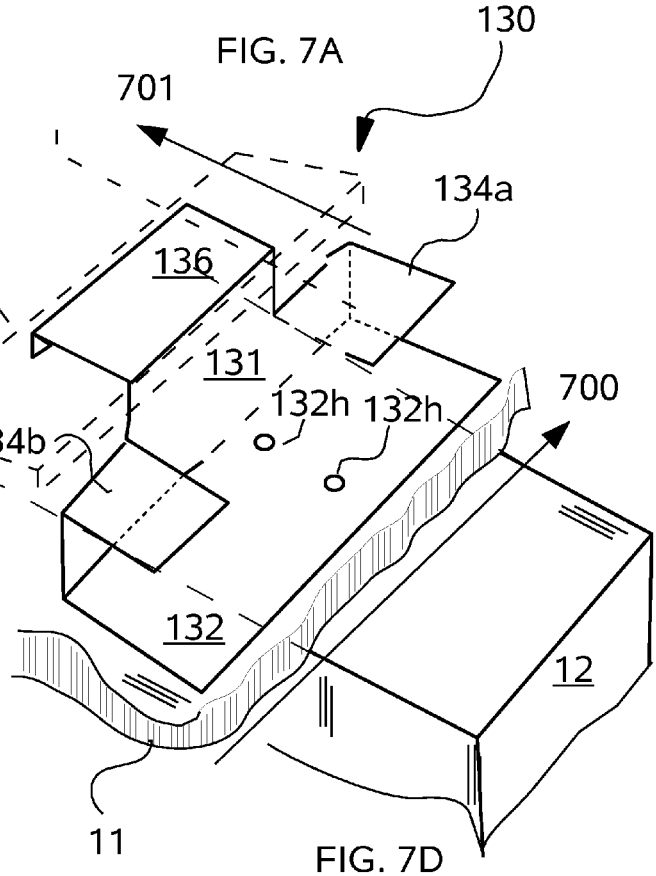
Figure 7C:
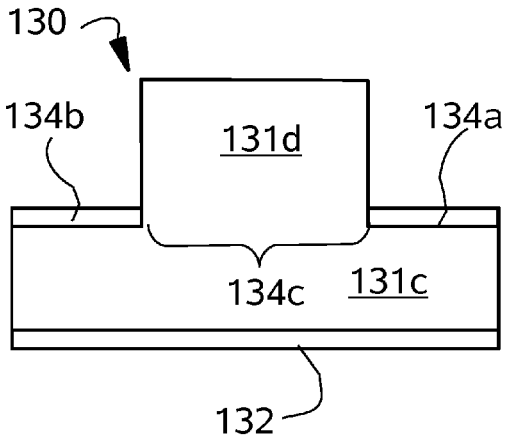
FIG. 7C is a front exterior elevation thereof and FIG. 7D is a back exterior elevation thereof.
Figure 7D:
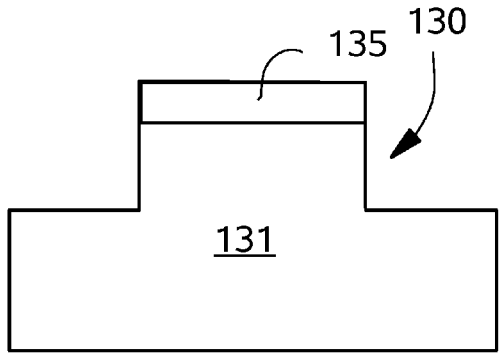

An alternative embodiment of the bracket 130 and mounting system is shown in FIG. 7A-D that now includes an intermediate mounting member 735. It should first be noted that bracket 130 is mounted with its primary axis 700 parallel to the fall line of the roof 10 such that mounting holes 132*h* are aligned with the center of rafter 12. This disposes the inverted "U" shaped intermediate mounting member or cross-tie strut 735 with its primary axis 701 transverse to the fall line, as the inverted cup or channel of the "U" shape mates with planar horizontal extending portion 136 of bracket 130. The planar horizontal extending portion 136 of bracket 130 also preferably terminates with a relatively short downward extending ledge 135 to provide further stiffness and support the intermediate mounting member 735. The intermediate horizontal member 134 is now subdivided to form a pair of inner shield support tabs 134*a* and 135*b*, with vertical portion 131 is now truncated to have a inverted "T" shape, as shown in FIGS. 7C and 7D, such that the lower base face 131*c* is wider than the upper base face 131*d*.

Figure 8B:
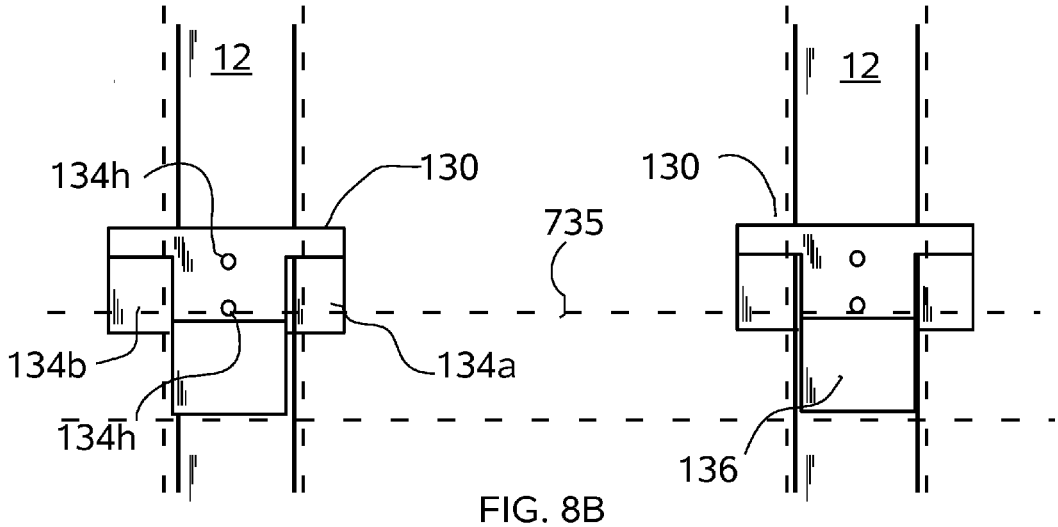
FIG. 8B is a plan view of the region shown in FIG. 8A.
Figure 8A:
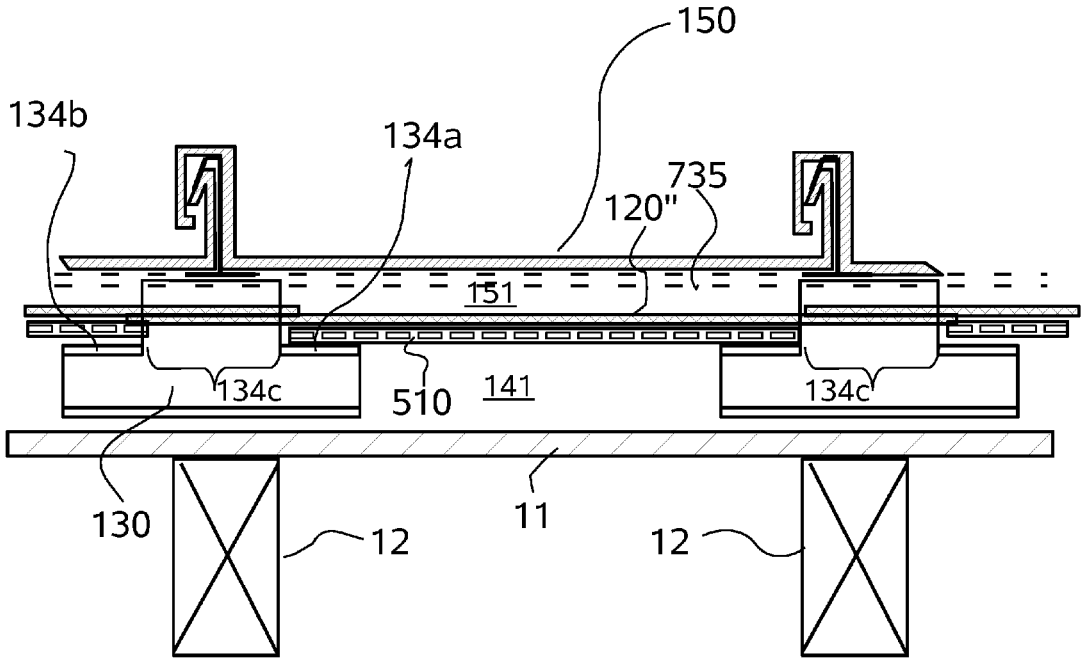

The bracket 130 shown in FIG. 6-7 can be mounted on existing roofs as well as plywood sheathing with further attachment to the underlying roof rafters or framing 12 in several orientations. However, the configuration shown in FIGS. 8A and 8B is preferred as all the brackets 130 in the installation are mounted in the same orientation such that the inner shield support tab 134*a* and 134*b* extend over or straddle rafters 12. As shown in FIG. 5, the thermoplastic resin support panels 510 can now rest on the inner shield tab supports 134*a* and 135*b* whereas wider sheets of radiant barrier material 120 are in turn disposed over them to form inner layer 140. As shown in FIGS. 5 and 8A, in order to prevent air flow between cavities 141 and 151, which would otherwise occur at gaps between rectangular thermoplastic resin support panel 510, it is more preferable that inner layer 140 be constructed of a lower layer having a covering that seals these gaps. As for example, such as the thermoplastic resin support panels 510 that rest on the tabs 134*a* and 134*b*, and a second or radiant barrier layer 120" disposed thereon to cover any gaps between adjacent edges of rectangular panels. This can be accomplished by overlapping adjacent portions of the radiant barrier layer 120" associated with the upper portion 131*d* between 134*a* and 134*b*, denoted as 134*c*. Thus, radiant barrier sheets 120" should generally be wider than panels 510 to provide the overlap region 134*c* to cover such gaps.

Figure 10:
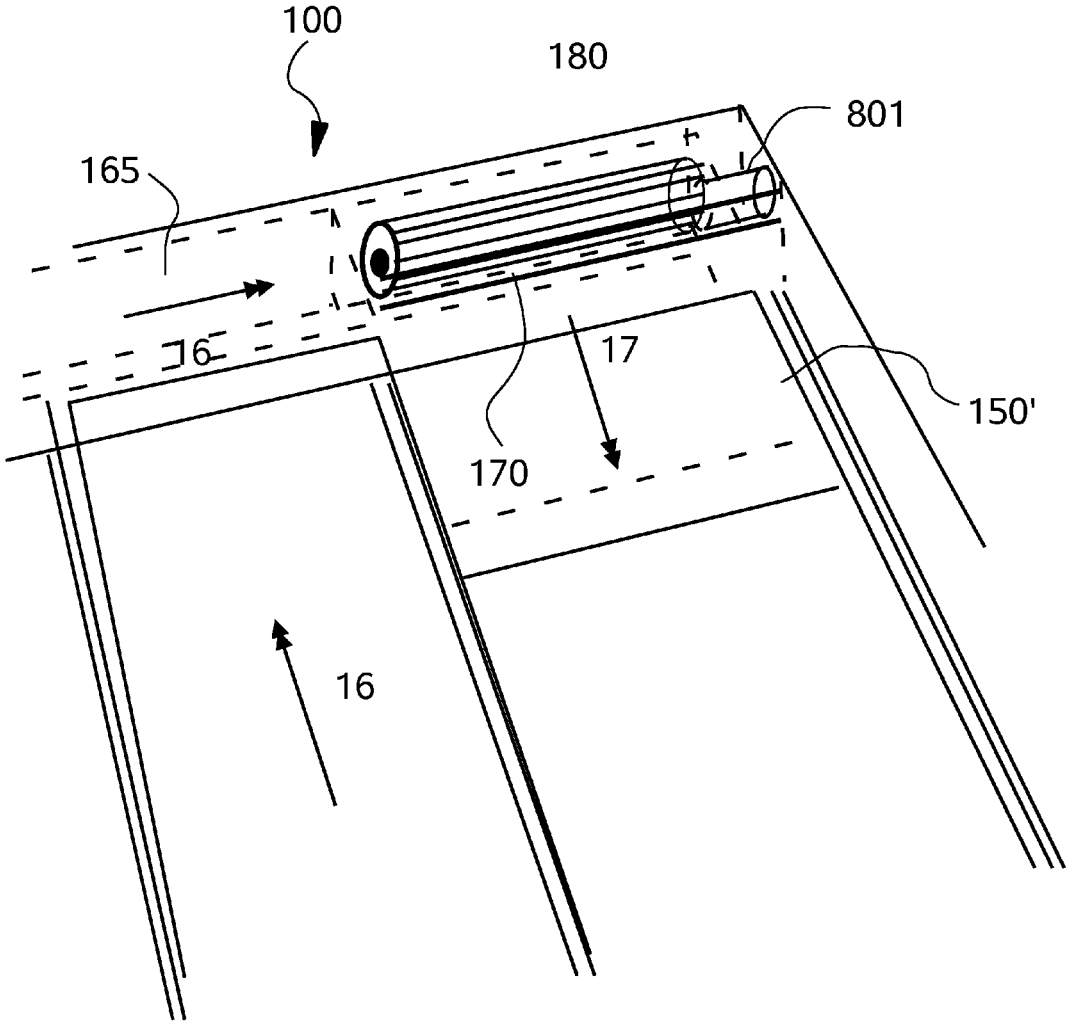
FIG. 10 is perspective view of the cross-flow fan of FIG. 9 and the adjacent roof structure and duct.

In the embodiment shown in FIGS. 9 and 10, fans 180 that deploy motor 801 are disposed at the sides of the roof at the ridge to receive air from a common duct 165. Duct 165 is below the outer roof layer 150 and runs along the roof ridge up to fans 180. The baffle 175 is disposed between the common duct 165 and the upper cavity 151 and has a series of apertures 176 that vary in open area, preferably via a variation in width across the horizontal expanse thereof. The variation in the aperture size allows for uniform air flow distal and proximal to the fans 180 and 180', via double headed arrows 16 showing the direction of air flow from the air vents 160 toward the common duct 165. Duct 165 preferably has a square cross-section as shown in FIG. 1C, with sides about 4.75" long, which is the same height of the baffle 175. Double headed arrows 17 show the direction of flow of airs exiting the duct 165 via fans 180.

Further, as shown in FIGS. 9A, 9B and 10, the outlet for air drawn through the opening 176 in baffle 175 is the cross flow fan exhaust port 170 located in the upper right cover of the baffle 175, which rather than being in fluid communication with cavity 151, is open to the external air above the exterior end panel 150' of the roof 150.

Figure 11:
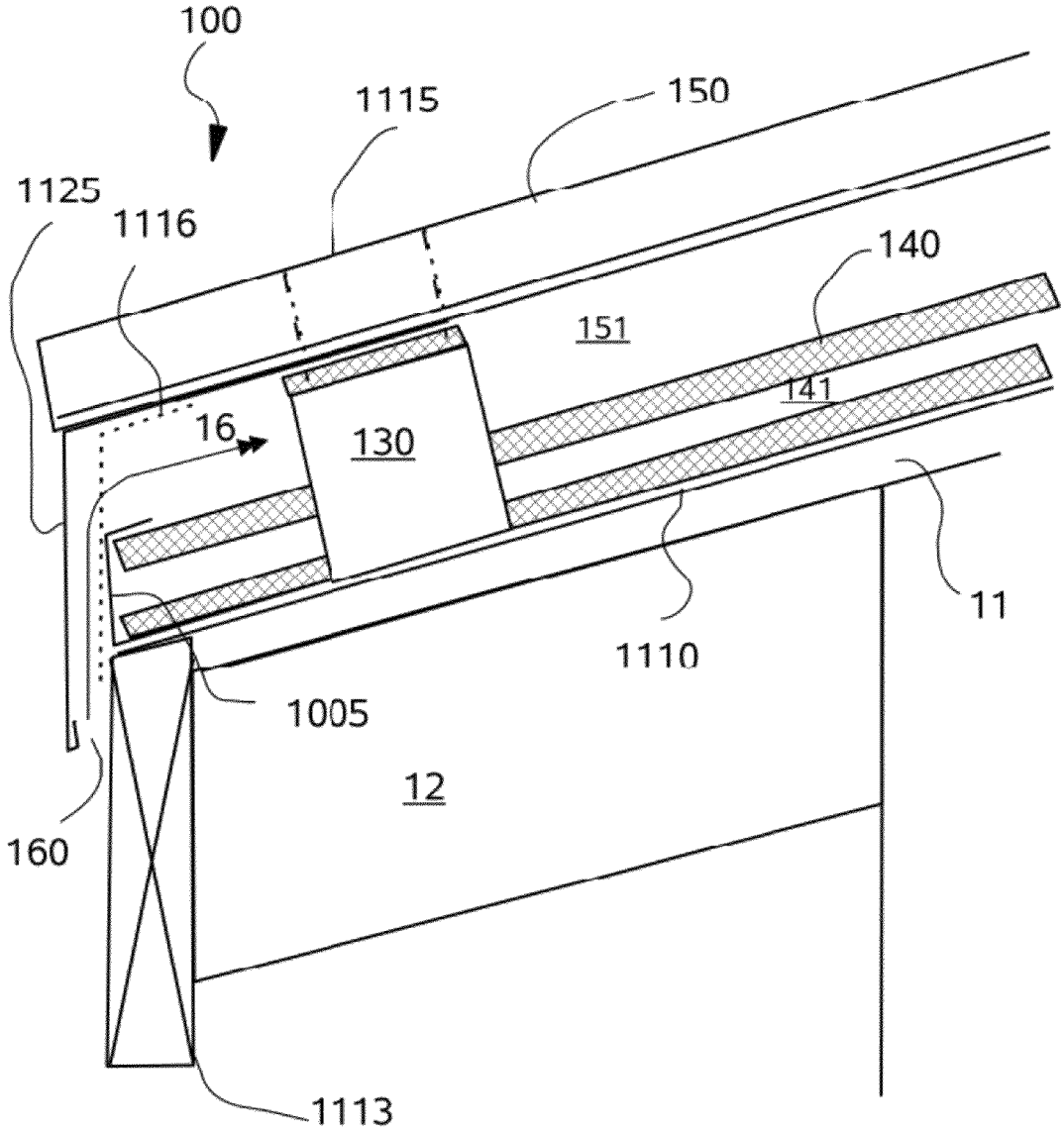
FIG. 11 is a cross-sectional elevation of an embodiment of the heat shield system at the edge of a roof showing a mounting bracket and screened eave vents and supporting framing.
Figure 12:
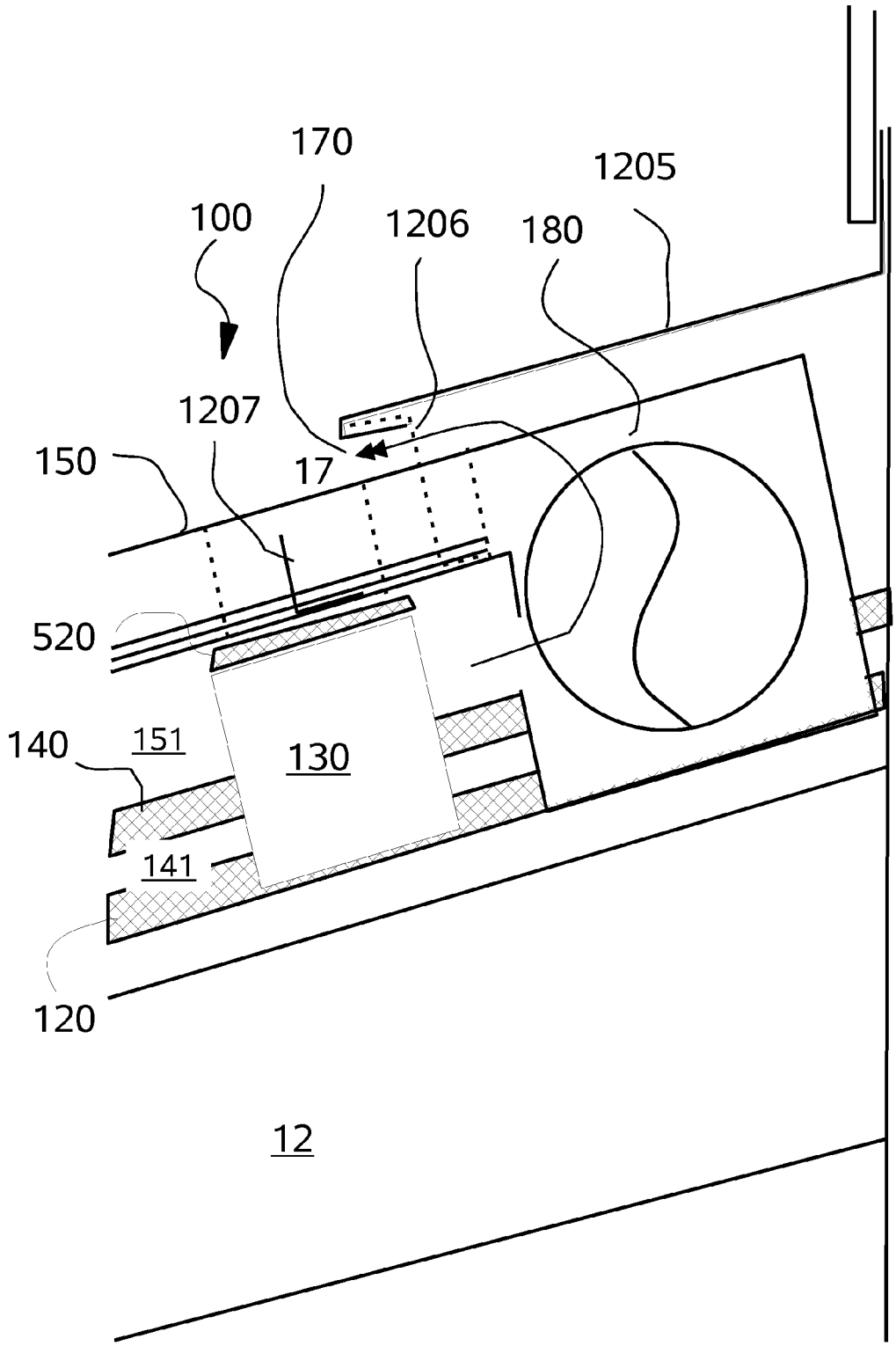
FIG. 12 is a cross-sectional elevation of another embodiment of the heat shield system showing a cross-flow fan and connected air outlet.
Figure 13:
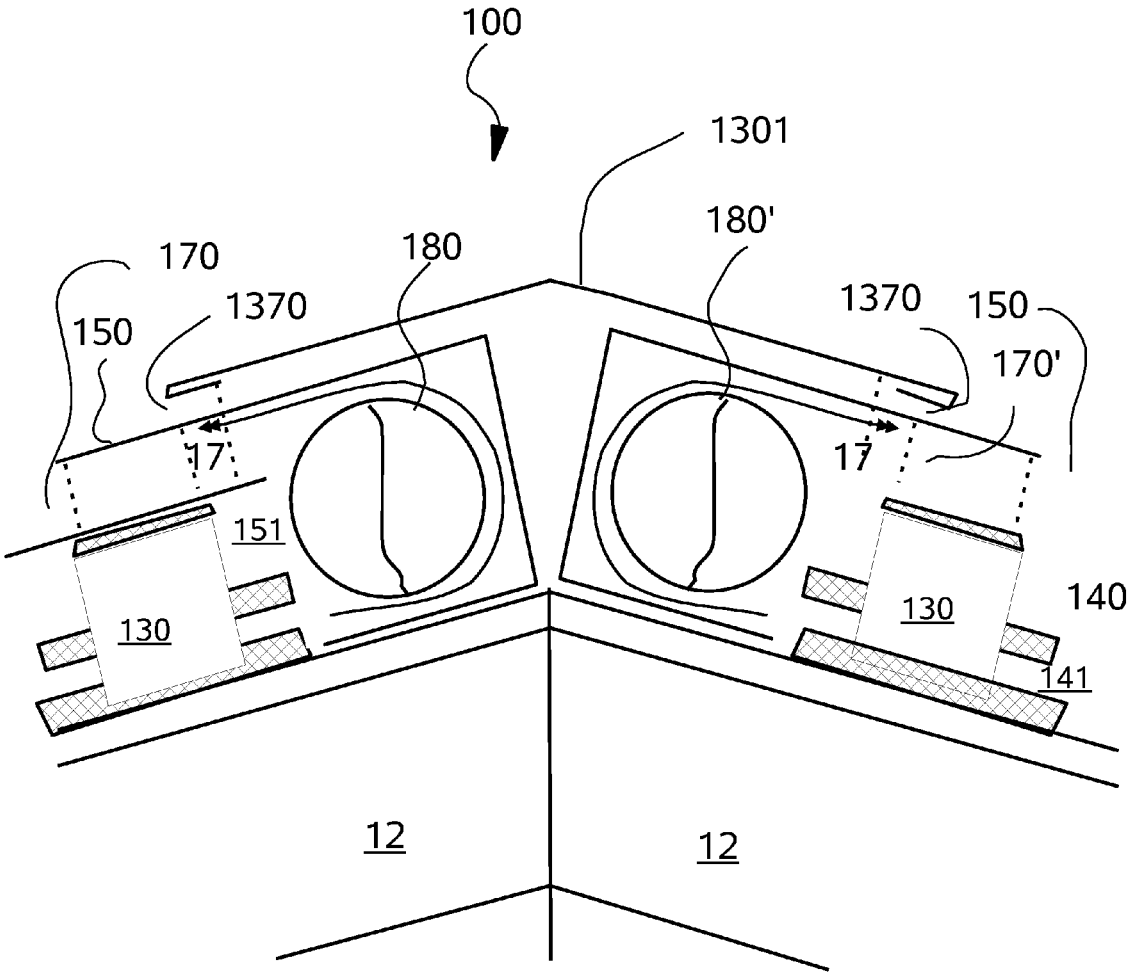
FIG. 13 is a cross-sectional elevation of another embodiment of the heat shield system showing mounting brackets and a pair of cross-flow fans and connected air outlets on opposite sides of a roof ridge.

FIG. 11-13 illustrates further details of different embodiments of the heat shield system 100 with respect to installation on a pitched roof. FIG. 11 is a cross-sectional elevation of an embodiment of the heat shield system at the edge of a roof showing a mounting bracket and screened eave vent 16 and supporting framing 12. A water proof roof membrane 1110 is installed over the supporting framing 12 and the eave fascia 1113. The outer roof member 150 is attached to the bracket 130 by the roof panel clip 1115. A solid eave 1125 extends downward from below the end of the outer roof member 150. A perforated eave vent screen 1116 is installed in the spaced between the solid eave 1125 and the end of upper cavity 151. A "J" shaped bracket 1005 acts as a closure to seal the end of the lower cavity 141 just above the eave fascia 1113.

FIG. 12 is a cross-sectional elevation of another embodiment of the heat shield system showing a cross-flow fan and connected air outlet for air flow along the direction of arrow 17 in which roof wall flashing 1205 extends over the air outlet 170. A perforated "Z" shaped member 1206 is installed to cover the air outlet 170 above outer roof member 150. An "L" shaped weather rain stop 1207 member is instated on the surface of the outer roof member 150 just below air outlet 170.

FIG. 13 is a cross-sectional elevation of another embodiment of the heat shield system 100 showing mounting brackets and a pair of cross-flow fans and connected air outlets on opposite sides of a roof ridge. The pocket formed between fans 180 and 180' by the roof ridge cap 1301 is itself vented in the usual way, having air outlets 1370 and 1370' on opposite sides. The air outlets 170 and 170' for fans 180 and 180' having the comparable structure to that illustrated in FIG. 12.

Figure 14:
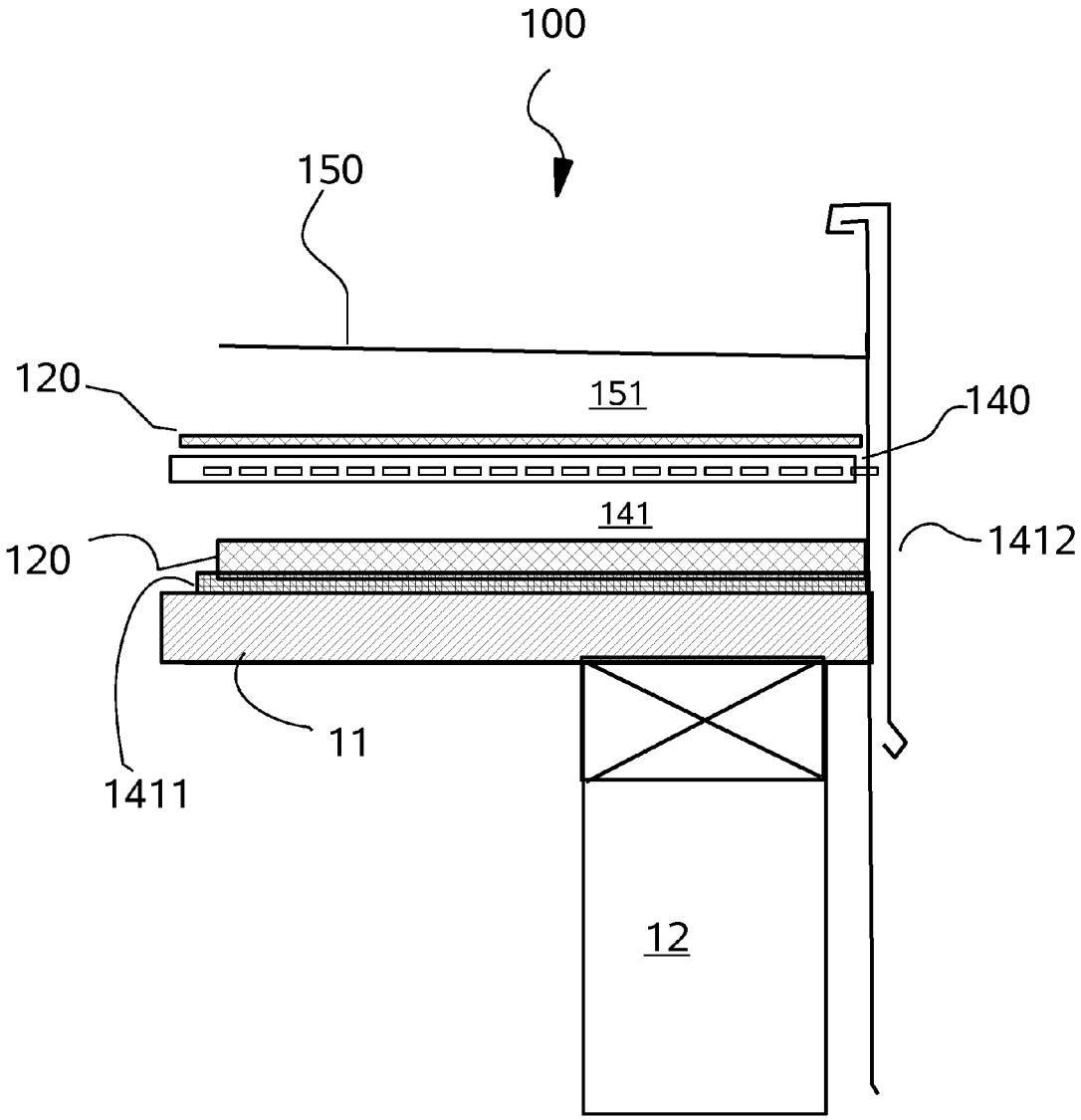
FIG. 14 is a cross-sectional elevation of another embodiment showing preferred components for implementing another embodiment of the heat shield system at the edge of a roof.

Another aspect of the invention is the installation of the inventive system, in particular in that it can be installed over existing roofs, as well as used in new construction. In the embodiment of FIG. 14, the shield system 100 is retrofit to existing roof structures to provide a cost efficient and expedient means for building's owners and/or operators to reduce the demand of electrical grid-based cooling systems that would utilize fossil fuels, hence reducing the so-called carbon emission footprint. This is particularly desirable when an existing single layer conventional roof, such as a shingle roof, shake roof and the like in need replacement due to damage or wear of the shingles 1411 disposed on roofing felt, such as 30# roofing felt. The system 100 can be advantageously constructed over other types of single layer conventional roofs that need replacement, without removing the shingles or other outer covering, and thus avoids creating waste that must be disposed of in landfills.

A first radiant barrier 120 cover is then installed directly on the shingles 1411. Then mounting brackets 130 are installed connecting to the underlying roof framing or outer sheathing.

The new outer roof structure is preferably assembled in parallel modules using insulating support brackets 130 that support the outer surface and the barrier that separates the upper and lower cavity. The rectangular inner roof skins 140 are then installed by connection to the brackets 130, followed by connecting the outer roof skin 150 to the upper portion of the brackets. In such an installation it would also be desirable to attach a gable rake trim 1412 that extends above upper roof member 150 by about 1.75 in. As with other embodiments, the lower and upper cavities 141 and 151 preferably have a height of about 1.25 in. This step, if deployed, would then be followed by the installation of the fans 180 and baffles in fluid communication with upper cavity 151. Then the fans 180 would be wired in signal communication with a controller or central processing unit (CPU) 17100 that receives inputs from a plurality of thermal sensors and at least one power source 190. This step would be followed by placing a covering on the duct that is in fluid communication between the upper cavity 151 and the fans 180, as well as any associated baffle. This controller 17100 can be a general purpose computer, depicted microprocessor, programmable logic controller (PLC) and the like.

As heat naturally rises, it is most preferable that the fans 180 are configured to operate with a controller 17100, described in further detail below, which modulates their speed and/or the duty cycle in a manner that assists the natural air current of cooler air entering channel 151 at the roof eave. In other embodiments that may be preferable in longer roof segments or in higher thermal loads where multiple PV cells and fans are deployed along the roof.

As most structures are heated by sun striking the roof and the eastern and western walls, it is expected that by installing the novel system on those portions of buildings, the need for air conditioning can be reduced greatly, thus fulfilling the objectives of the invention. Such a configuration is illustrated in FIG. 15-16

Figure 15:
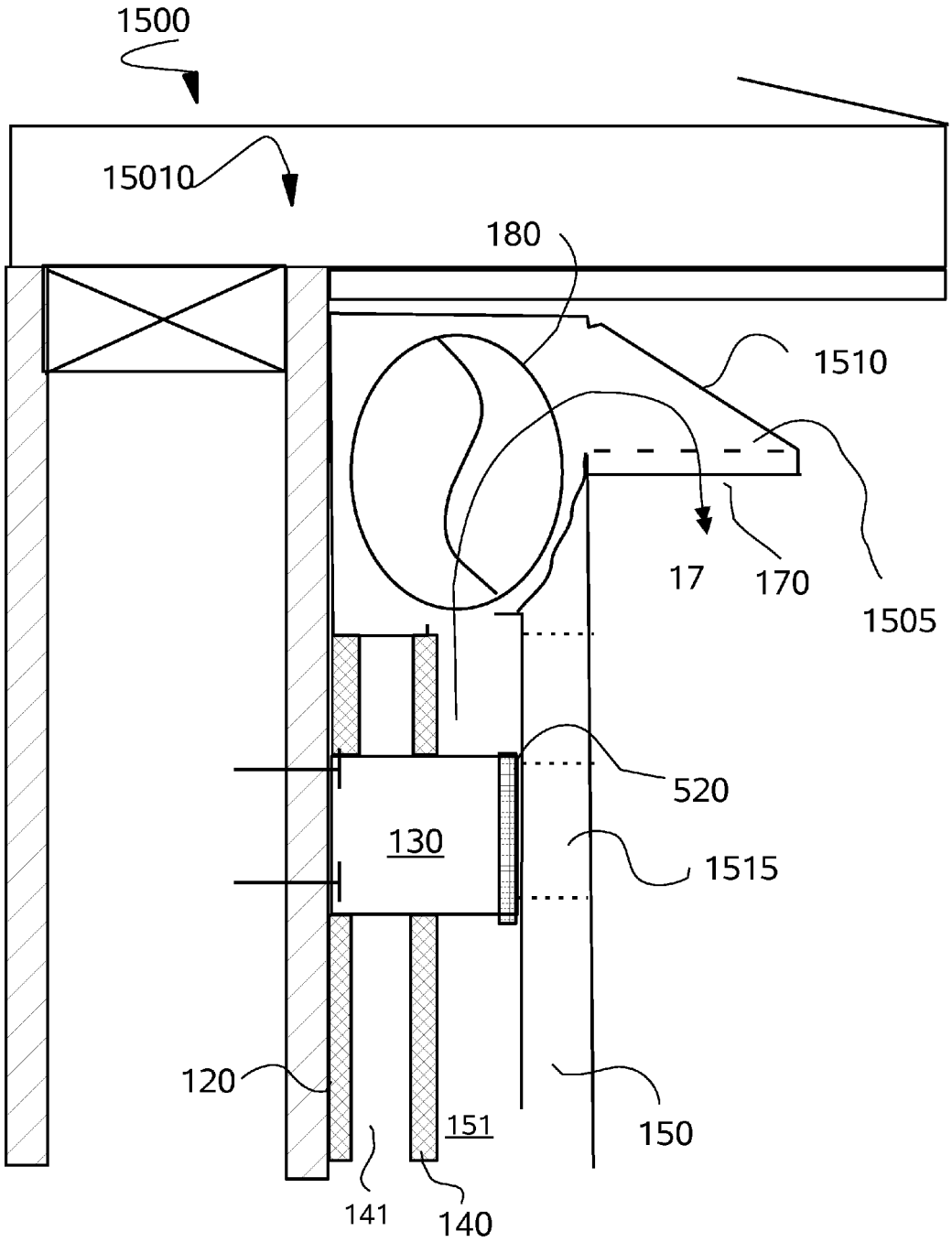
FIG. 15 is a cross-sectional elevation of another embodiment showing preferred components for implementing another embodiment of the heat shield system at the top edge of a vertical wall.
Figure 16:
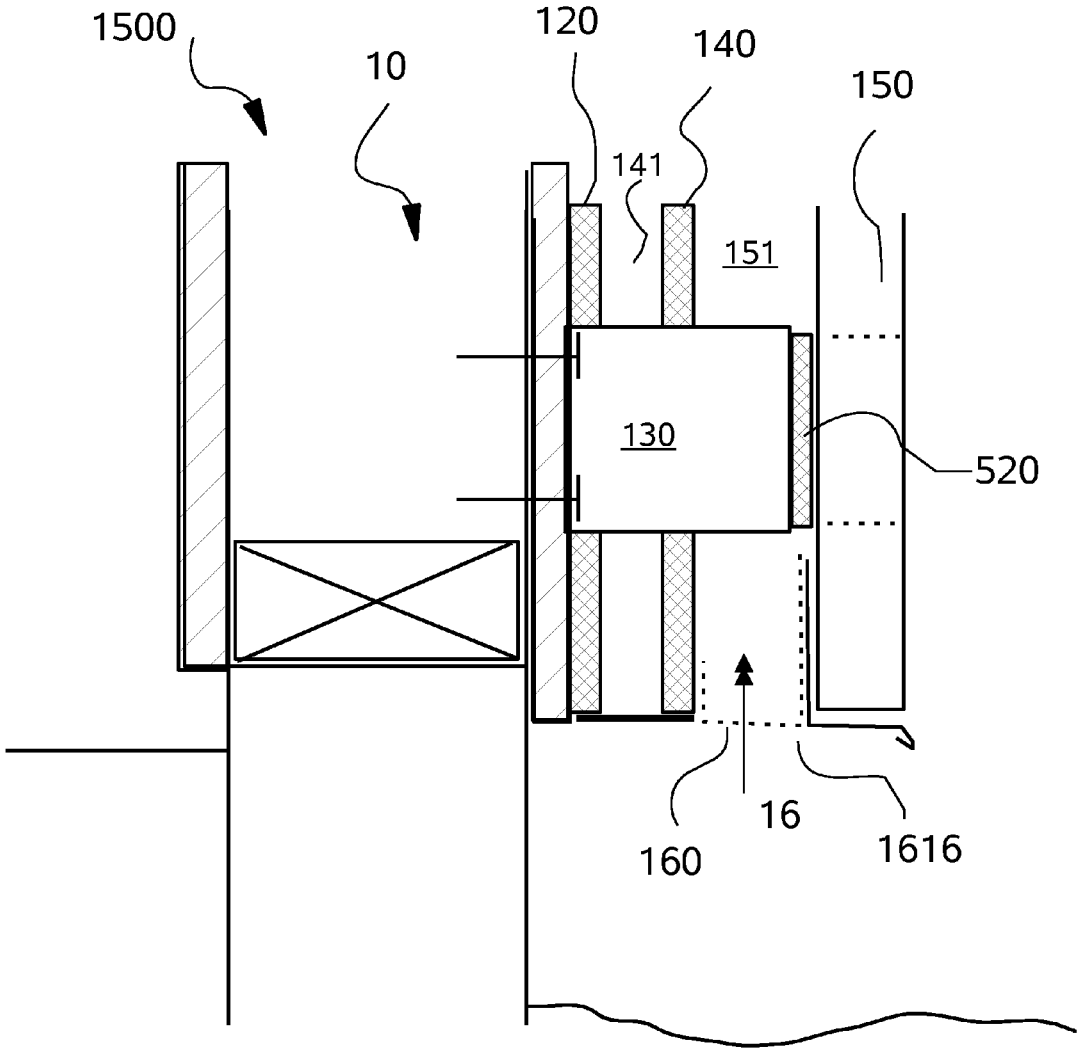
FIG. 16 is a cross-sectional elevation of another embodiment showing preferred components for implementing the embodiment of the heat shield system of FIG. 15 at bottom edge of the vertical wall.

FIGS. 15 and 16 illustrate the application of the above embodiments on the sidewall 15010 of a structure, with FIG. 15 illustrating the position of fan 180 at the top of the building sidewall with air outlet or vent 170, and FIG. 16 showing the bottom of the same wall with air inlet 160, both in fluid communication with an outer cavity 150. The inner cavity 140, formed by inner barrier layer 140, is sealed at the top in FIG. 15 and the bottom in FIG. 16.

As shown in FIG. 15, the air outlet 170 is covered by the down draft exhaust duct 1510. The down draft exhaust duct 1510 also support the insect screen 1505 that is placed in front of air outlet 170. The outer wall member 150 and inner wall member 140 are supported by bracket 130 that is either a material of low thermal conductivity, such as plastic or polymeric resin, or includes the optional thermal block member 520 between it and the connected outer wall member 150. The outer wall member 150 is connected to the structural wall 1510 via bracket 130 using an outer shield wall panel clip 1515. Bracket 130 also supports the inner wall member 140 that includes a composite radiant barrier 120' held on the previously discussed 'COROPLAST'™ backer 510. Thus, cooler outside air enters wall cavity 140 via air vents 160 protected by screen 1616.

Figure 17:
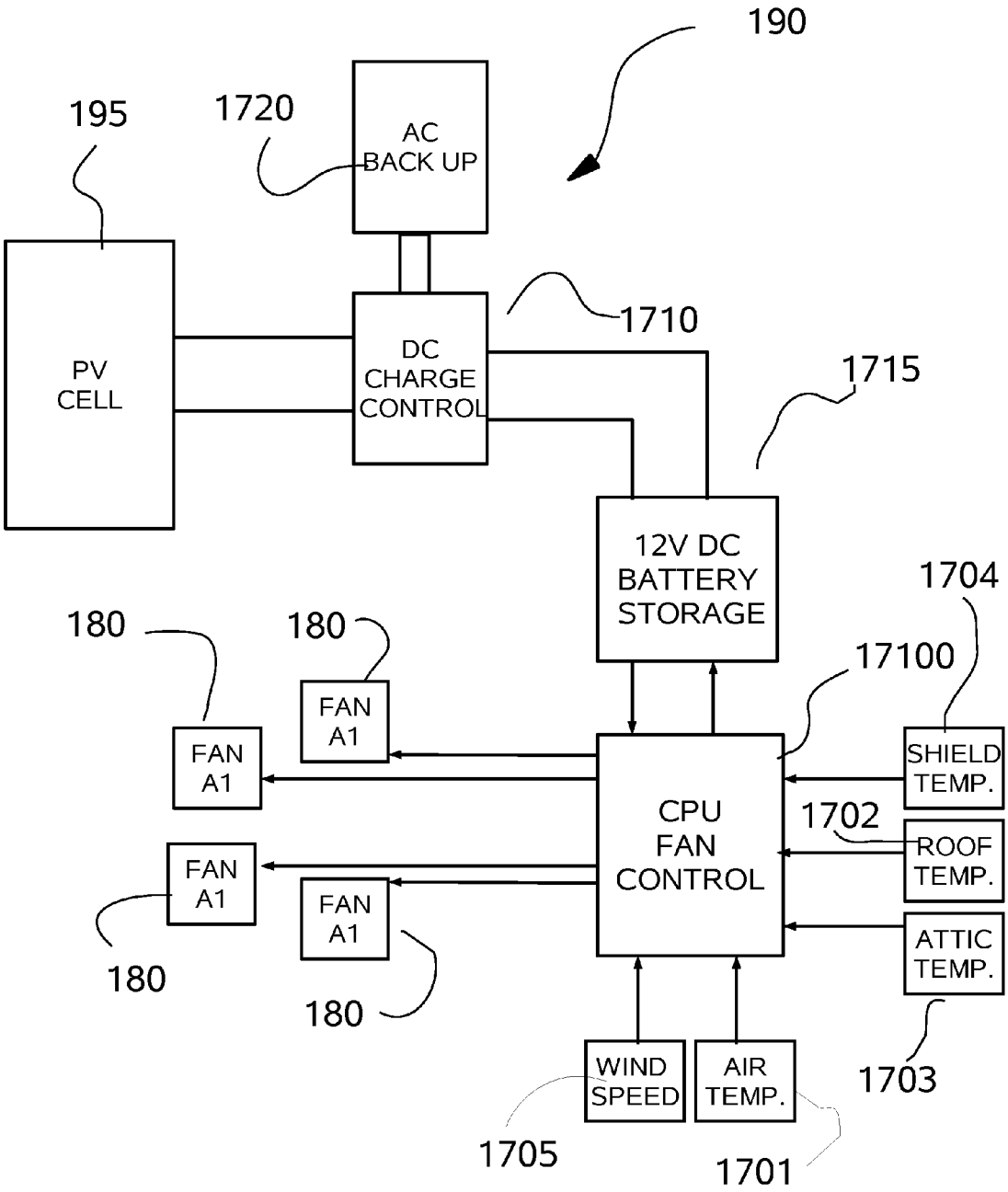
FIG. 17 is a schematic diagram illustrating the operative connections between multiple sensors, fans and a power supply system via a controller.
Figure 18:
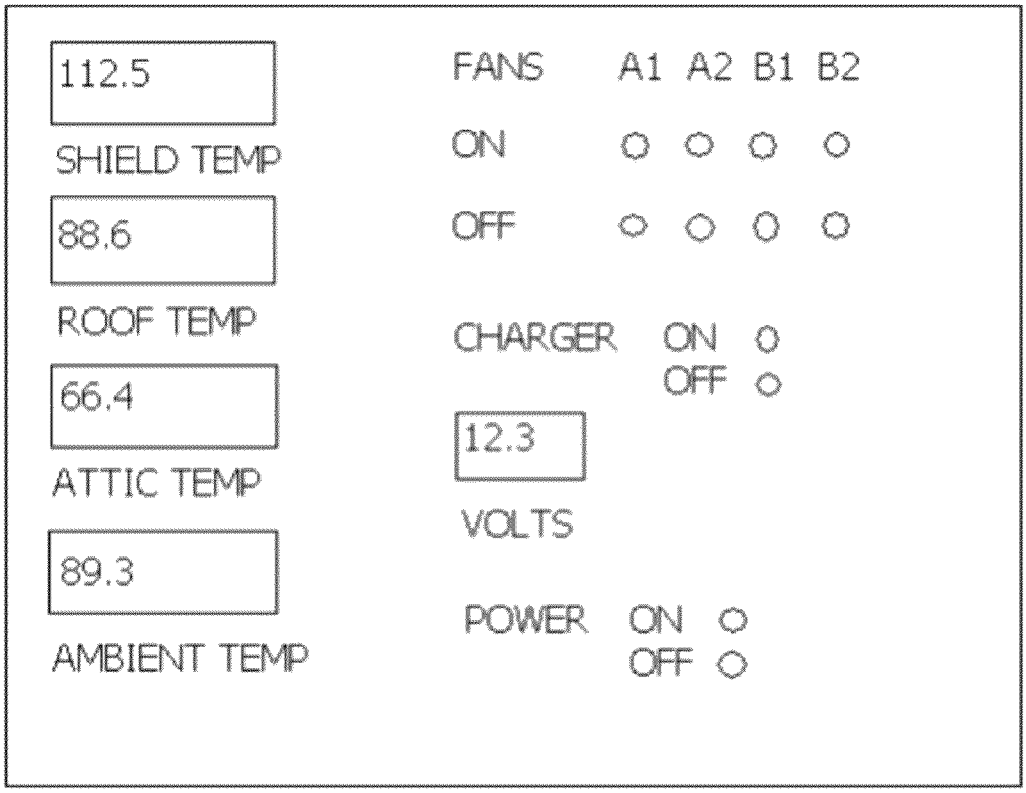
FIG. 18 is an exterior elevation of an embodiment of the controller for the system shown in FIG. 17.
Figure 19:
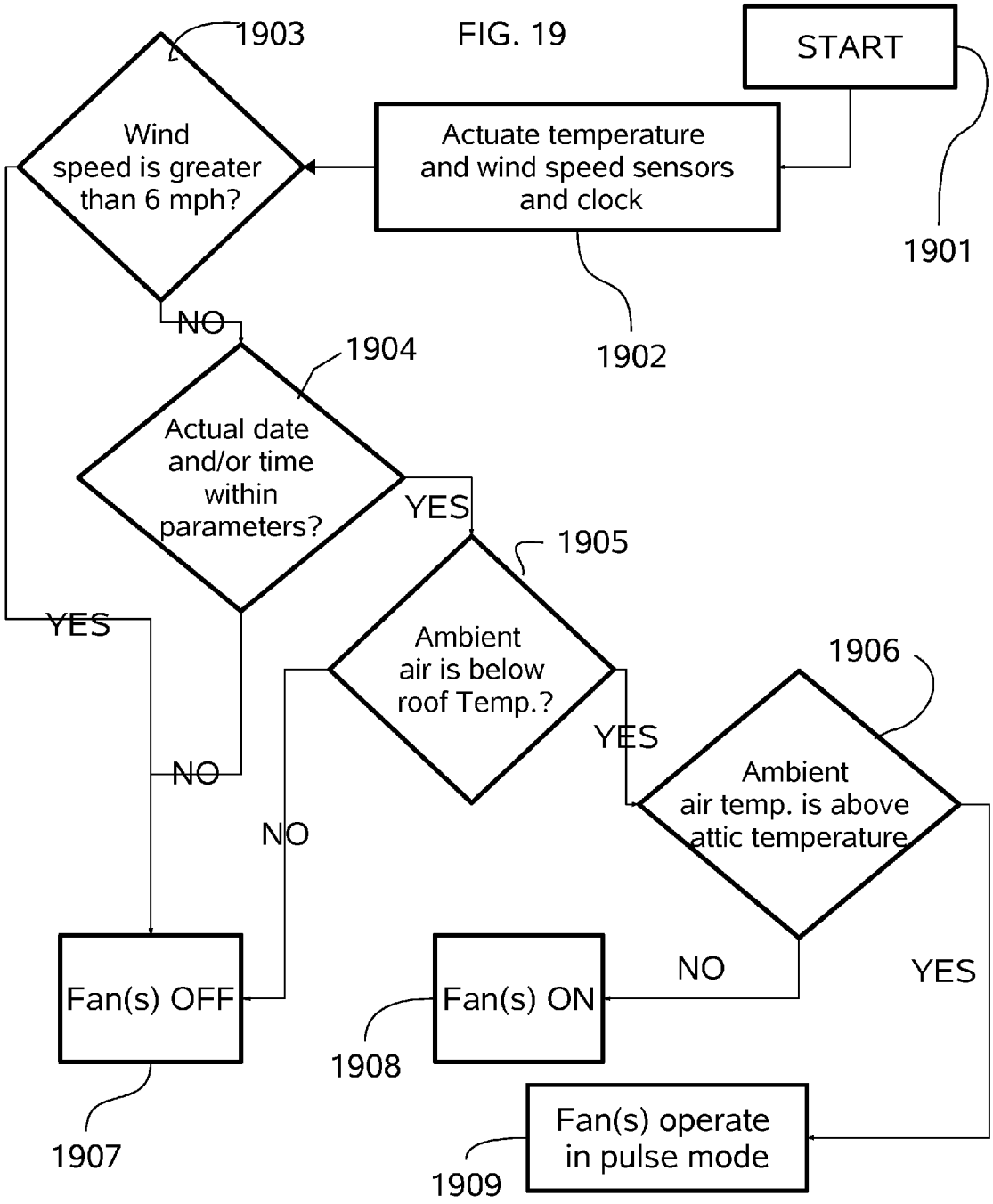
FIG. 19 is a flow chart illustrating an embodiment of the control process for the system shown in FIG. 17.

In the more preferred embodiments, system 100 includes various sensors to determine the optimum time and duration for powering fans 180 to reduce the potential for solar radiation and ambient air to heat the inside of the building or structure 1. Thus, preferably as shown in FIG. 17-19, the fans 180 are responsive to the control system 17100 when the preferred operating conditions are met with respect to thermal, time or wind conditions. In one such embodiment, an ambient air temperature sensor 1701 is placed in shade-protected eave area at the lower side of the roof to measure the temperature of external air. A roof temperature sensor 1702 is preferably placed laterally in the upper third and center of the roof area, which is normally expected to be the warmest part of the roof, but vertically between the structural roof or wall 11 and the first radiant barrier 120'. Further, an attic temperature sensor 1703 would be placed below the roof sensor in the attic crawl space, if there is an attic. Otherwise, this attic sensor 1703 is preferably placed inside the roof frame cavity via a hole drilled from the roof side into the insulated space just above the interior ceiling, with this hole being subsequently sealed with conventional sealant.

Further, the system 100 would also preferably deploy a wind speed sensor 1705 and an internal clock in the CPU 17100. It may also be desirable to deploy a shield thermal sensor 1704 that is deployed below, but in thermal contact with the outer roof layer 150.

Thus, another aspect of the invention is the process illustrated in FIG. 17 in which the upper cavity is selectively ventilated by a plurality of fans 180 via a controller 17100 that is operative to selectively enhance the air flow through the upper gap 151 based on at least one of thermal loads, thermal measurements and exterior thermal emissivity.

It should be appreciated that the method of ventilating the structure disclosed herein can be deployed in a roof or wall protective structure having just a single air spaced cavity that is ventilated, though it would be less effective than the preferred implementation of a single closed air cavity 141 disposed below the ventilated cavity 151.

As shown in FIG. 17, either cooling system may also include a power system for the fans 180 that also preferably the charge control module 1710, battery 1715 as well as an AC back up power source 1720, as well as one or more PV cells 195. Charge control system 1710 monitors the battery 1715 and upon detecting that the power reserves is low, then recharges the battery from either the PV cells 195 or the AC back up power source 1720. The controller/CPU 17100 is powered from one of the battery 1715 or charge control system 1710 with the required constant DC voltage to run the microprocessor(s) or programmable logic controller (PLC) there within. Provided the power required by the operative fans 180 is met by the output of the PV Cells 195, they are generally used rather than draining the battery 1715, but when the PV Cells 195 provide insufficient output, the charge control system 1710 is operative to power the fans 180 by the AC back up power source 1720.

Thus, it is also preferred that the system 100 deploy circuit protection devices between the fan motor wiring connection to the PV cell 195 to assure the applied voltage and current will be at minimum levels to prevent damage before powering the fan motor(s) 180.

FIG. 18 is an example of an external indicator for such a control system that displays the temperature at the above sensors, the operating status of the fans 180 and the status of the charger and battery charge level.

FIG. 19 illustrates an embodiment of the control process for the system 100, starting at step 1901, after which the above temperature sensors 1701, 1702 and 1703 are provided and actuated, along with a wind speed sensor 1705, and a clock in step 1902. Then, instep 1903, a determination of wind speed is made. If the wind speed in greater than a predetermined value, in this example about 6 mph, the fans 180 are shut down in step 1907, until the system detects a change in wind speed. When the wind speed is less than 6 mph, control proceeds to step 1904, in which the time of day is determined. Preferably, the fans 180 will also be limited in operation to the appropriate time of day and season or date so that maximum benefit is obtained from cool night air in the summer, and the roof system 100 retains heat at night in the winter. Thus, depending on the pre-set or predetermined time and date consideration, the fans 180 could subsequently be turned off again in step 1907. However, depending on local conditions the clock times and dates leading to non-operation of the fans might be different or not necessary.

If the time/date for turning on the fans 180 in step 1904 is appropriate, control moves to step 1905, in which the ambient external air temperature from sensor 1701 is compared with the temperature of the roof as measured by sensor 1702. When the ambient air temperature is above the roof temperature, then control moves to step 1907 in which the fans are turned off. It would also be preferable that under such condition, the controller 17100 would be further operative to charge the battery when PV Cell 195 generated power is not needed to run the fans 180.

If the ambient air temperature is below the roof temperature, then control moves to step 1906. In step 1906, ambient external air temperature from sensor 1701 is compared with the temperature of attic, or the temperature sensor disposed below the roofing member that supports the first radiant barrier 120', as measured with sensor 1703. When the ambient air temperature is above the attic temperature, then the fans 180 are operated in step 1909 in a pulse mode. As a non-limiting example of the pulse mode of operation, the fans might run for about 2 minutes, and then pause for 13 minutes, that is operating about 8 minutes per hour. When the ambient air temperature is not above the attic temperature, then the fans 180 are operated continuously in step 1908. The intermittent operation of step 1909 is intended to remove excess heat in cavity 151, without overheating the underlying structure from the warmer ambient air. It should be appreciated that this example of pulsed operation or limited duty cycle is not intended to be limiting, and may include a method of modulating the fans, including a lower speed of operation that assists natural convention of air form cavity 151.

It should also be appreciated that at reaching any of steps 1907-1909, the process re-starts at regular intervals in step 1901, should thermal, clock or wind conditions change. Such intervals can range from fraction of a second to scores of minutes if desired.

It is generally not necessary to run the fans 180 when the wind speed exceeds a predetermined value, as the wind itself ventilates the cavity 151 and externally removes heat from the exterior roof 150 by convection.

Moreover, to the extent that the geographic region of the installed system 100 has large differences between the evening or night temperature and day time temperature, further steps may be taken to initially draw cool air into cavity 151 at night or early in the morning, but not operate the fans 180 until a predetermined temperature is reached, and thus avoid faster heating of the roof and structure from the ever warming ambient air in the later hours of the day.

While the controller 17100 for air flow is thus primarily responsive to ambient temperatures and air flow, it can also be programmed to account for the local solar exposure and thermal absorption and emissivity of roof, which depend at least in part on color. Further, controller 17100 can be programmed for at least one of winter and summer operation in the embodiments of FIG. 21-24, as discussed further below.

For ambient conditions where rapid changes occur in temperature, wind, and weather, the controller may preferably have a rate change anticipation circuit which will signal the fans to activate when sensing rapidly rising temperature rates or to shut down the fans when rapidly dropping temperatures occur because of weather changes. This will have small but significant energy savings effects on the battery.

It should be further appreciated that the process shown in FIG. 19 is preferably applied to each zone of the roof system 100 having separately operable fans 180 associated with drawing ambient air into different roof or wall cavity portion 151, each having its own local thermal sensors. Thus, depending on the time of day and shading by the environment, only the portions of the roof receiving the most direct solar exposure might need to be ventilated by this process.

It should also be appreciated that the control of fans 180 can operate in a proportional control mode, as well as a proportion-integral-derivative control and thus also be logically dependent on the rate of temperature change, as in the manner of proportional temperature controller, rather than or in addition to absolute temperature control. Thus, the cooling air flow into cavity 151 may be initiated when the rate of heating as measured by thermal sensor 1703 exceeds a predetermined value or a combination of a predetermined temperature and predetermined value, so that the cooling is more effective in preventing the attic air from exceeding another predetermined temperature limit. Such a control scheme would preferably be in a feed forward control mode, and take into account for the time it would take to cool the roof based on the ambient air temperature, the time of day, the time of year and or the thermal absorption and emissivity of the materials that form the outer roof member 150.

It should be further appreciated that each fan 180 needs a connection to the power source, the means for switching the fans between the "on" and "off" states, as well as their optional speed control can be at the power source or at the fans. To the extent the switching is at the fans, or between the fan and the power source, the switching signals can be sent over a separate wiring system, or as a pulse train superimposed on the power distribution line to the fan motors 180.

Although the preferred fan configuration has vertical rotary axis parallel to roof surface and perpendicular to slope direction, as shown in FIG. 9 other types of fans may also be deployed. While a preferred location for this type of fan is at the top ridge and side to pull air from the roof via baffle or manifold to provide a uniform pressure drop and hence substantially uniform lateral airflow across the upper cavity 151, other types of fans may be advantageously situated in alternative locations.

Figure 20:
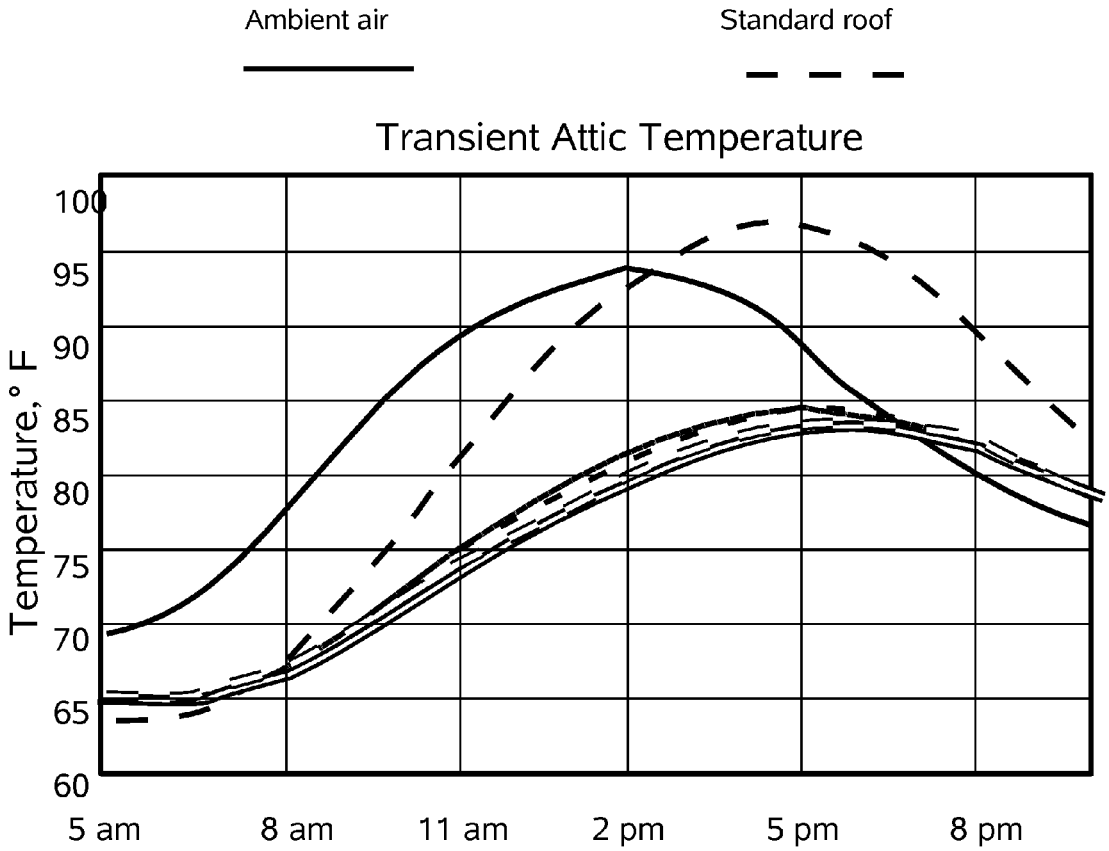
FIG. 20 is a chart showing the predicted performance of various embodiment of the inventive system during the daytime.

FIG. 20 is a graph of the temperature variation during the day (from about 5 am to about 10 pm) illustrating the performance of various embodiments of the inventive system as predicted by a computer model for an 8 ft. by 10 ft. prototype roof using weather conditions for an "average summer day" in Yuma, Ariz. The computer predictive model was developed from actual experimental data collected on prototypes deployed in Northern California. The chart compares the performance of the heat shield system with a single cavity ventilated cavity against the inventive dual cavity system at air flow rates of 110 cfm and 2100 cfm with a conventional shingle roof. The lines associated with the different conditions are indicated as a matrix in the legend of this figure for double and single cavity roofs at the two air flow rates. This simulation also shows that the external air temperature, which peaks at about 93° F. at about 2 pm, will result in a conventional roof heating the attic to about 97° F. between 4 to 5 pm. A ventilated single cavity roof reduced this maximum temperature to about 85° F., and slightly delayed the time at which this temperature is reached till slightly after 5 pm. The double cavity system disclosed herein reduced the peak temperature further to about 83° F., and also delays the peak temperature to slightly later in the evening. The differences in attic temperature between air flow rates of 110 cfm and 2100 cfm were not significant under these model conditions.

Thus, it appears that the structure cooled by the novel method and structures will need less power to cool the interior of a structure with air conditioning, as well as for fewer hours during the day. This early afternoon cooling is significant, as in warm climates electricity demand tends to peak during these hours as the interior of houses become warmer from heat conducted inward from the roof, as well as the owners returning and turning up the air conditioning to reduce the internal temperature to a more comfortable level.

FIG. 21-30 illustrate additional embodiments of the invention wherein either a dual or single cavity roof structure is used for passive heating (in the winter) and cooling (in the summer). In one such embodiment, air from the upper cavity 151, which is cooled by both the drop in outside night time temperature as well as by natural radiation of heat into the night sky, which occurs year round, is exhausted to at least one of the attic 2110 and the lower cavity 141 in the night time or early morning as selected by controller 17100. The cooler attic space 2110 can then cool the structure 10, and more particularly the dwelling or climate controlled portions 2105 thereof, as well as provide a storage buffer of insulated cold air for cooling the structure 10 during the day. Such a storage buffer would decrease the rate of heating from solar radiation during the following day time hours. Further, it is more preferred that this conditioned air from the either a single or dual cavity shield system is integrated into the structure's 10 forced-air ventilation system, as further illustrated and described below. At least a portion, but preferably all of the attic space 2110 is lined or covered with thermal insulated to retain the temperature of air received therein from the outer roof cavity or upper roof cavity 151. It is also preferable (FIGS. 21A and 21B) that air warmed in the daytime in the climate controlled portion is returned to the upper cavity 151 (via arrow 2135) for further cooling at night via either a pair of vertical adjacent baffles 2132 and 2133, in which baffle 2132 connects the attic space 2110 with the climate controlled region 2105, and baffle 2133 connect immediately adjacent portion of the attic above baffle 2132 to the upper cavity 151. Alternatively, as shown in FIG. 21B, a single baffle or duct 2134 can connect the climate controlled portion 2105 directly to the upper cavity 151 so that air flows directly thereto via arrow 2135. It should be appreciated that ducts/baffles 2132/2133 or 2134 are placed below the lower portion of the roof such that air flows upward within cavity 151. Alternatively, in the summer air optionally flows from climate controlled region 2105 to the upper cavity during the early evening or nighttime hours for cooling in response to controller 17100, which is preferably operative to open baffles 2132/2133 or 2134, and more preferably to also closes any external air inlets to upper cavity 151, such as air vents 160. The novel ventilation of the upper cavity at night eliminates the need open windows at night, eliminating the risk of burglary or other intrusion via open windows.

Alternatively, in the winter, air that is heated by winter daytime sunlight in the upper cavity 151 can also be stored or vented to the attic 2110 to warm the structure 10, as well as aid in heating the climate controlled portion 2105 of the structure, or slow the rate of cooling at night. The controller 17100 can be optionally programmed to move the air from the upper cavity 151 into the lower cavity 141 or attic space 2110 when the optimum temperate is sensed.

Further, air stored in the attic space 2110 can also be moved into the climate controlled portion of the structure 2105 through additional means as shown in FIG. 21-26. FIGS. 21A and 21B are cross-sectional elevations of non limiting examples of such embodiments in which a conditioned air mixing unit 2120 in the attic 2110 harvests the air stored in the attic space 2110, receiving it at a first selective intake baffle 2121 before passing it through an air filter 2123, with the air flow being generated by the blower or fan apparatus 2185 in the center thereof. The fan apparatus 2185 is configured within the mixing unit 2120 to force the cooled or heated air that enters the attic space 2110 from the common duct 2160 (which in the embodiment of FIGS. 21A and 21B is disposed below the outer roof layer 150) into the climate controlled space 2105 below via the ventilation duct 2130. A second selective baffle 2122 allows the return of the air from the climate controlled space 2105 back to the attic space 2110. The first and second baffles preferably open and close in response to the controller 17100. Thus, air from the attic space 2110 is blown into the climate controlled portion 2105 of the structure 10 via supply duct 2130, with return or make up air entering the attic space 2110 via the second selective baffle 2122. The flow of air from the attic space 2110 into the climate controlled space 2105 of the structure 10 is indicated by arrow 2303.

Figure 22:
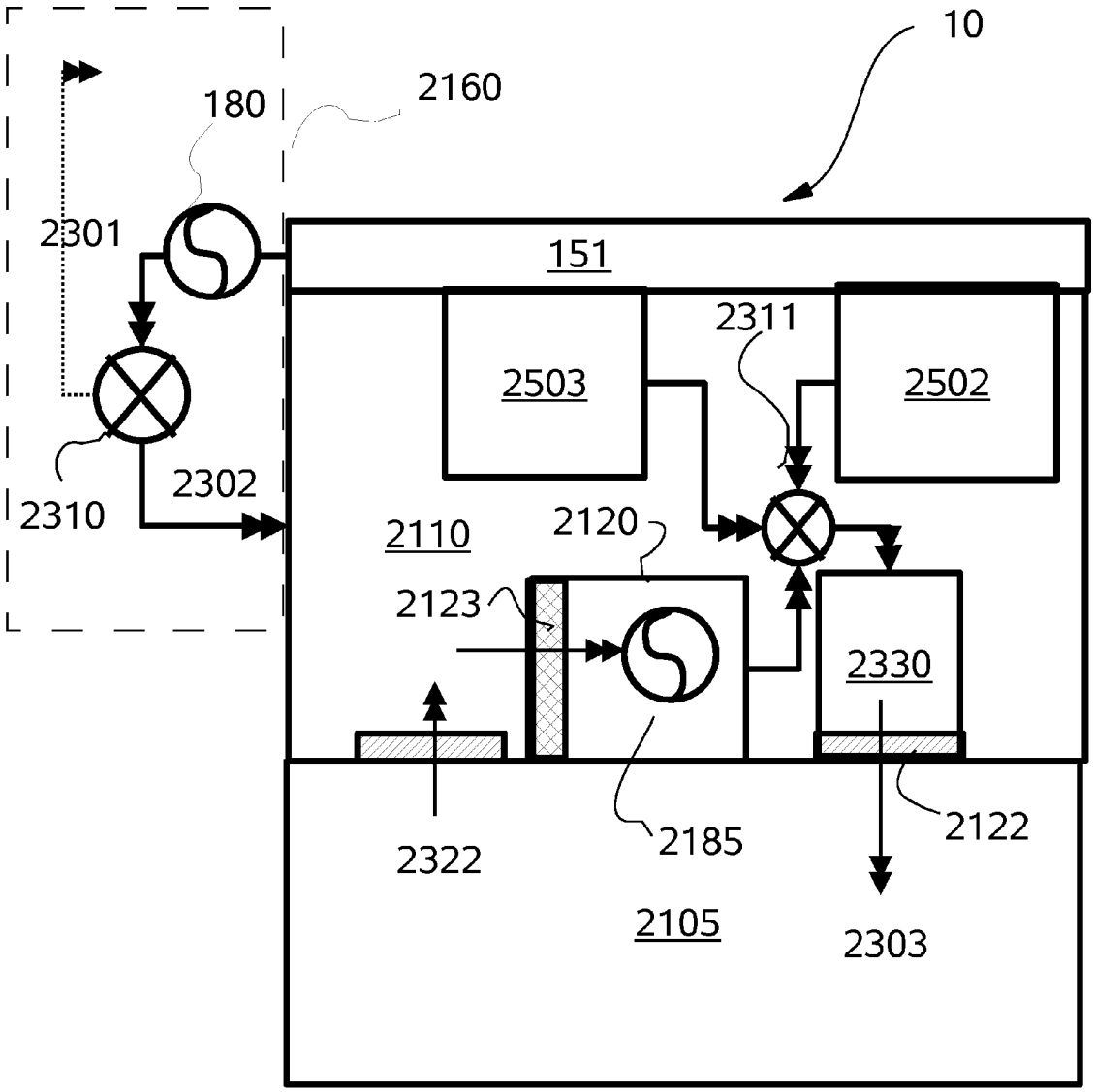
FIG. 22 a schematic diagram illustrating alternative operating modes for the embodiments of FIG. 21-28.
Figure 23B:
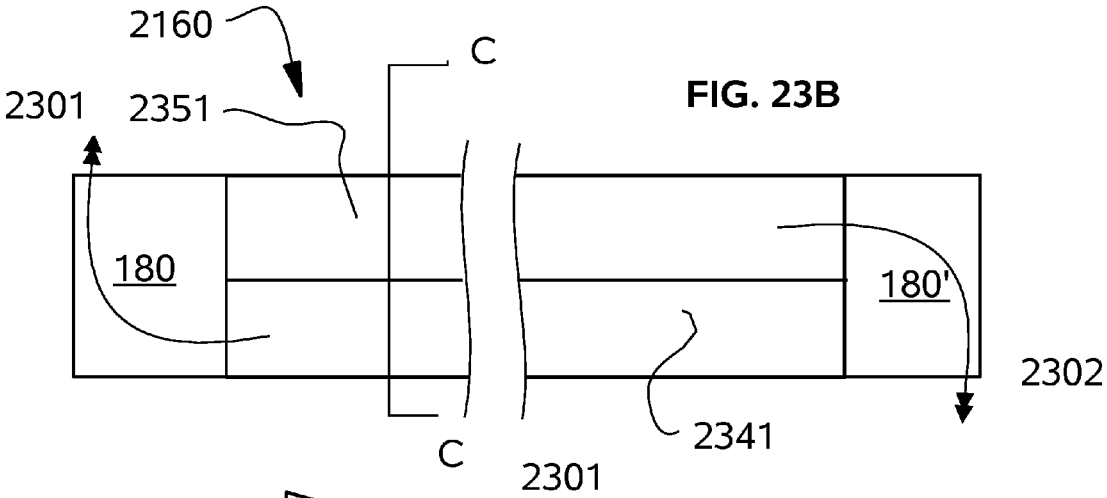
Figure 23A:
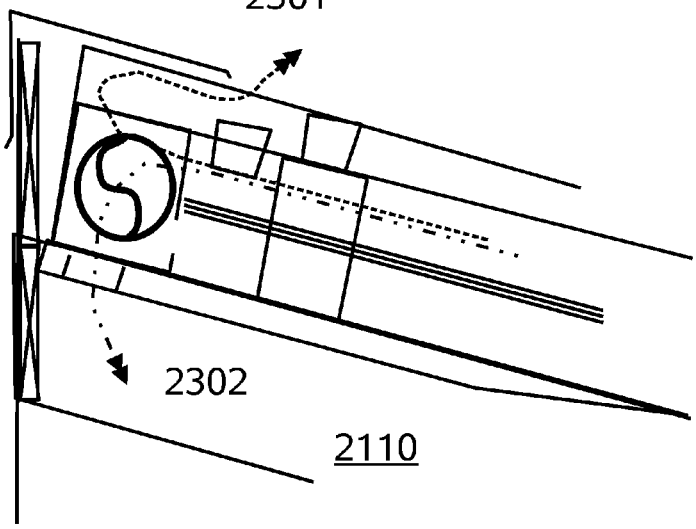
Figure 23C:
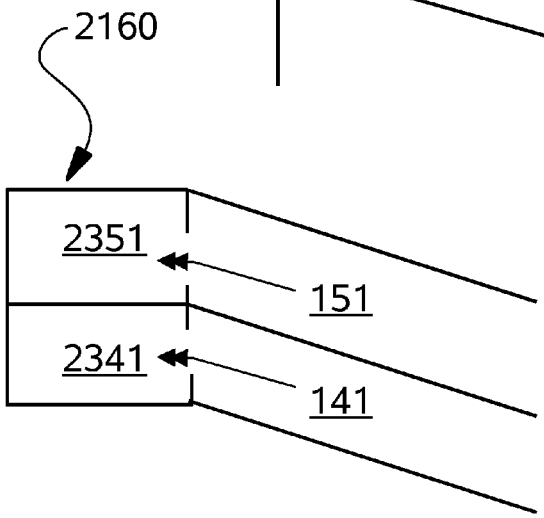
Figure 24:
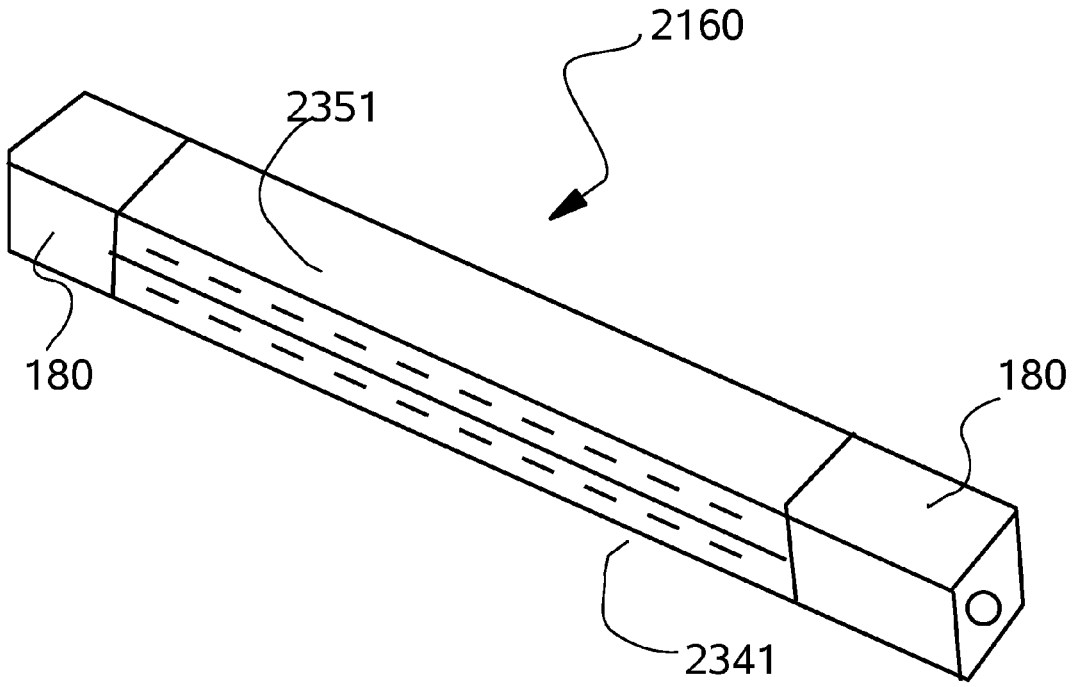
FIG. 24 is a perspective view showing the portion of the duct in FIG. 23A-C that is in fluid communication with the upper and lower roof cavities.

FIG. 22 is a schematic diagram more generally illustrating this concept in which a first flow diverting baffle 2310 is operative to direct air received from the upper cavity 151 toward either the attic space 2110 or outside to the atmosphere, with air being drawn into the baffle 2160 via fan 180. A conditioned air mixing unit 2120 in the attic 2110 preferably includes at least an air filter 2123, a second flow diverting selective baffle 2311 and a blower or fan apparatus 2185 in the center thereof. Thus, the fan apparatus thereof is configured to force the cooled or heat air that enters the attic 2110 from the common duct 2160 (disposed below outer roof layer 150) into the climate controlled space 2105 below. The second flow diverting valve or baffle 2311 is operative to optionally control the flow of air into the exhaust duct 2330. When air from the conditioned air mixing unit 2120 forces air into duct 2330 via the second flow diverting baffle 2311, the flow diverting baffle 2311 is also operative to seal the air flow that would otherwise arrive via either a forced air heater 2502 and/or air conditioning unit (A/C) 2503. Arrow 2322 indicated the flow of air back from the climate controlled space 2105 to the attic space 2110.

It should be understood that while the dual layer roof is the preferred means for supplying heated or cooled air to the attic space 2110, a single cavity roof structure can be similarly deployed. Alternatively, as illustrated in FIGS. 23A-C and 24, the duct 2160 that is capable of supplying air to the attic space 2110 can also be split into an upper chamber 2351 in fluid communication with the upper cavity 151 of the dual layer roof and a lower chamber 2341 in fluid communication with the lower cavity 141 of the dual layer roof. The lower cavity 141 and connected duct portion can be evacuated by the fan 180 connected at one end of the roof, while the fan 180' at the opposite end of the roof evacuates the other duct portion and the upper cavity 165. Apertures or baffles in the duct 2165 and associated fan chamber are provided to selectively open or close so the evacuated air can be expelled either outside the structure, exhausted to the attic space or the ventilation system, as appropriate to the season. Arrow 2301 indicates for example summer daytime air flow, whereas arrow 2302 indicates summer nighttime air flow when the night time air is at a sufficiently low temperature to be useful as a ballast or reserve buffer for future cooling. In contrast, in the winter, the warm day-time air heated by solar gain is exhausted into the attic space 2110 (arrow 2302) and stored therein, as well as then circulated through the house via a forced-air system ducts 2330. The thermal sensors described above, as well as additional thermal sensors, can be deployed to measure the temperature in the different roof and attic zones described above to enable the controller 17100 to operate such selective baffles and fans at the appropriate times to obtain the optimum benefit of the air cooled or heated in the upper cavity 151.

Figure 25:
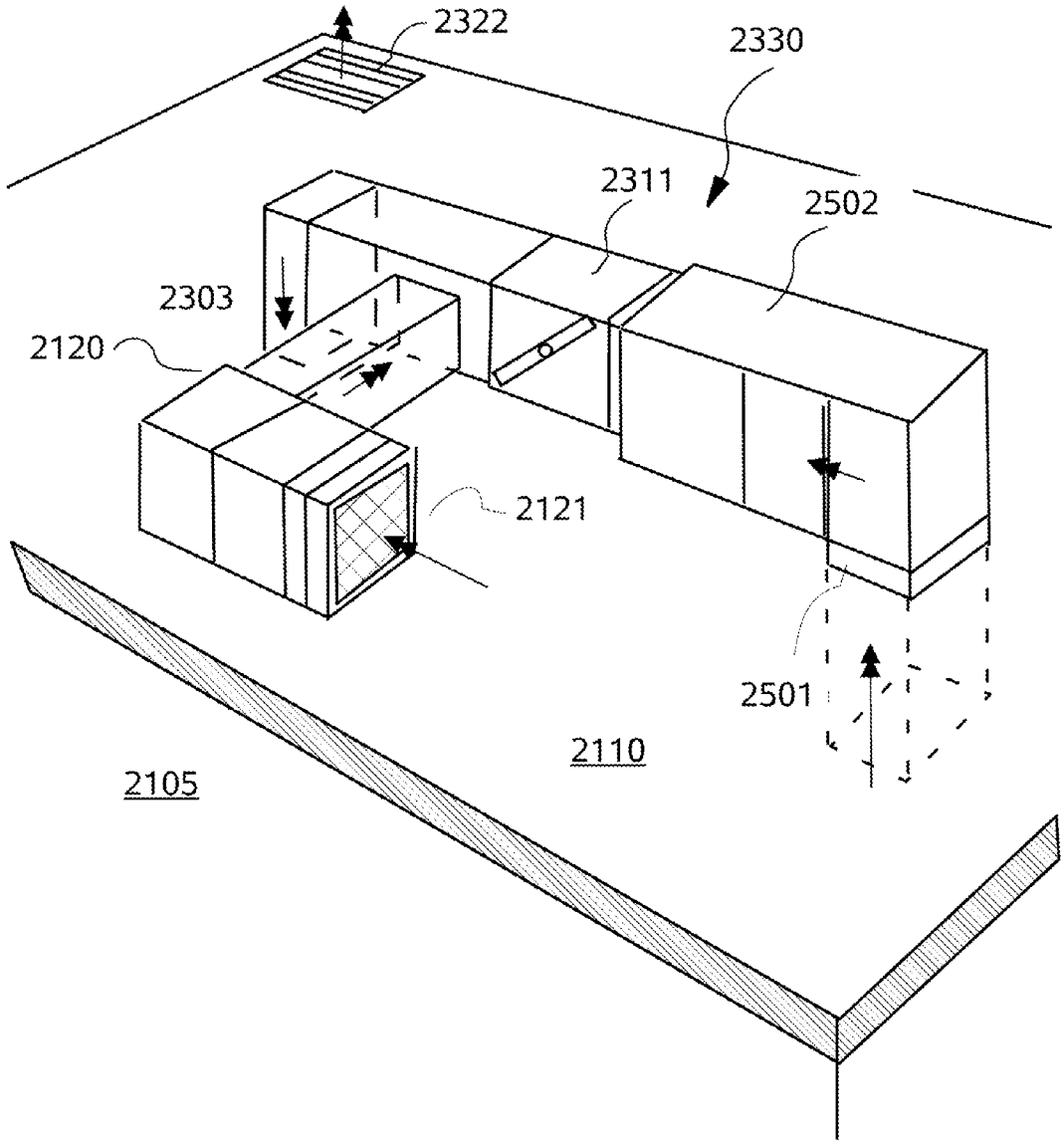
FIG. 25 is perspective view of an alternative embodiment to FIG. 21 of devices in the attic space for delivering attic air to the interior dwelling space of structure 10.

FIG. 25 is perspective view of a particular arrangement of the devices shown schematically in FIG. 22 for delivering attic space 2110 stored air to the climate controlled portion of 2105 of structure 10, from either the furnace 2502 or the air mixing unit 2120 via the common ventilation duct 2330. When flow diverting valve or selector baffle 2311 is closed to isolate the air that would otherwise come from the furnace 2502, such that air from mixing unit 2120 enters ventilation duct 2330, a controllable baffle 2322 is open to provide make up air from the dwelling portion 2105 below. In contrast, when the selector baffle 2311 open such that the heated air from furnace 2502 enters ventilation duct 2330, the furnace 2502 receives return air via inlet duct 2501. It should be understood that dwelling or climate controlled space in the structure does only refer to a portion of a structure or building used extensively for human or animal habitation or lodging, but rather to a portion of a structure wherein it is desirable to control the temperature for the benefit of either occupants or inanimate objects or contents there within.

Figure 26:
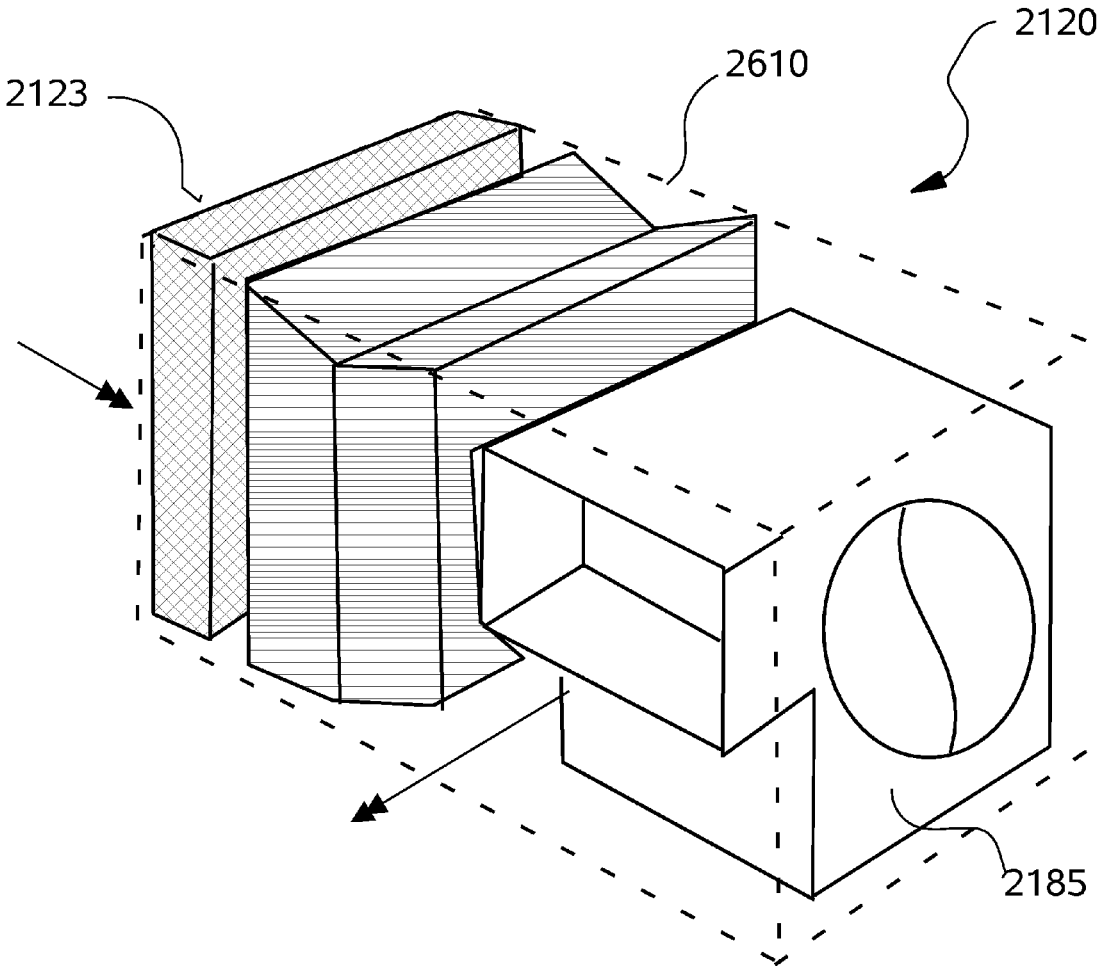
FIG. 26 is a perspective view of a more particular embodiment of select components in FIG. 25.

FIG. 26 is a perspective view of a preferred embodiment of the air mixing unit 2120 powered by fan 2185 and having on the intake side of the fan an air filter 2123 followed by a de-humidifier 2610 to optionally further condition the attic air before it is expelled to the ventilation system or the climate controlled space 2105, FIG. 25. It should especially be appreciated that de-humidifying the nighttime air also reduces its temperature further, as a much lower use of energy than air conditioning. While all or some of the fans, actuators, de-humidifier and related components are optionally powered by PV cells during the daytime, they can be powered by batteries at night, with the batteries being recharged by the PV cells during the day for a self containing system, or simply using mains power supply at any time of day or night.

As shown in the embodiments of FIG. 27-30, it is also possible to use the heat generated in the upper cavity 151 to heat water, such as for domestic water supply, pool or spa. Thus, before exhausting heated air from the upper cavity 151 via duct 2160, it is drawn over heat transfer coils or plates 2710 disposed. The heat transfer coils or plates preferably circulate water in a sealed system generating domestic hot water from the solar energy absorbed by the roof. The heat transfer coils or plates 2710 are preferably tubes in which water or another heat transfer fluid flows that have attached fines that run in the same direction as duct 2160 so that air flow is not impeded. Thus, the illustration of component 2710 is merely schematic to indicate a known form of air or flow heat transfer unit, radiator or heat collector.

Figure 27:
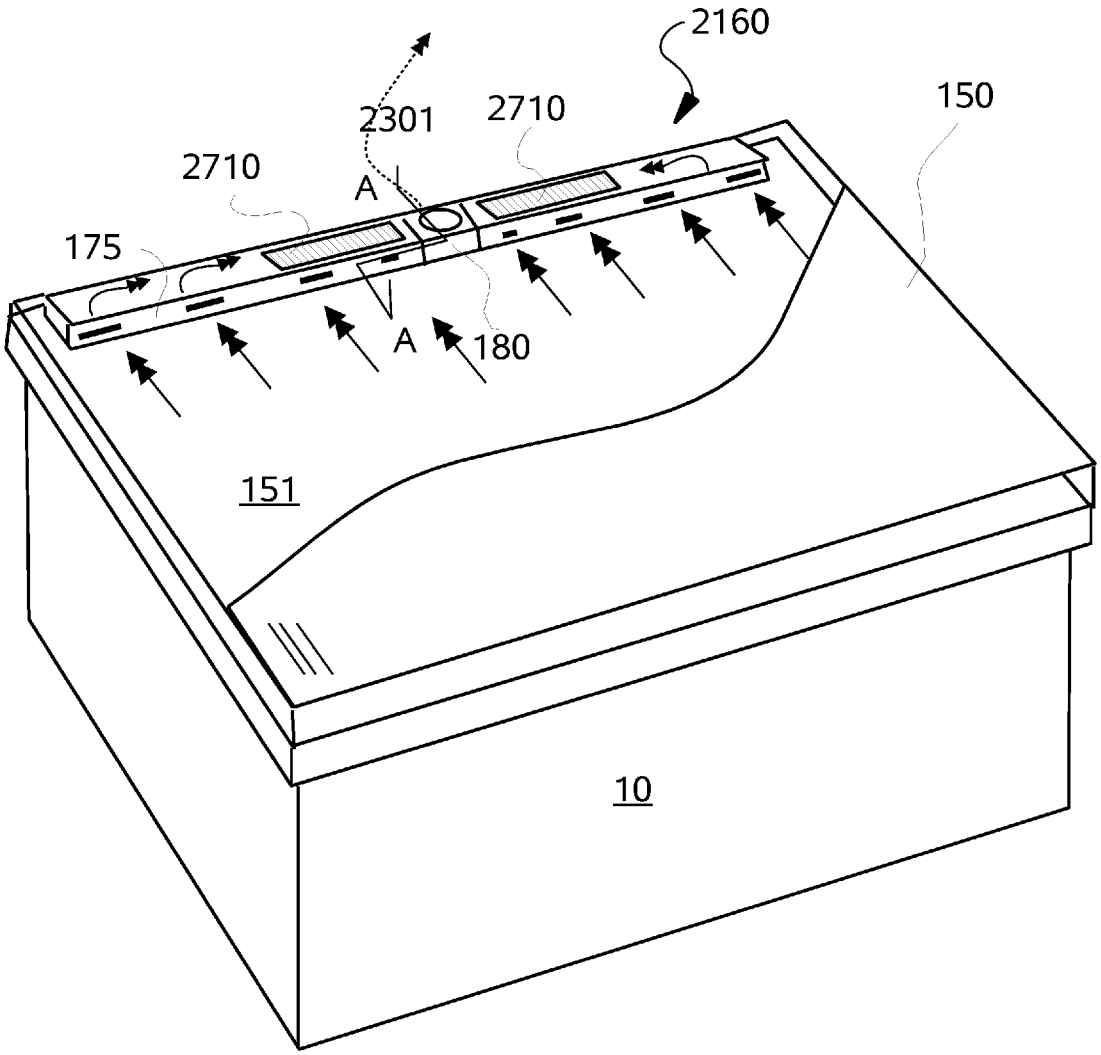
FIG. 27 is a cut away perspective view of a roof structure in an additional related embodiment of the invention.

In a preferred embodiment shown in FIG. 27, a single fan 180 is mounted in fluid communication within the center of the ridgeline or roof top disposed duct 2160, which is preferably covered by a screen 2677 at intake aperture 175 (FIG. 28), which then draws in heated or cooled air from upper cavity 151. Two heat exchange coils 2710 are preferably disposed as shown on opposite sides of fan 180. Reference line A-A in FIG. 27 is staggered to reflect the illustration of both the fan 180 and coils 2710 in the cross-sectional view in FIG. 28. It should also be appreciated that duct 2160 has an entry baffle 175 that deploys a series of graduated apertures 176 between it and the upper cavity 151 to provide a uniform flow of air across the lateral extent of both sides of the upper cavity 151. Further, the lower cavity 141 is preferably sealed and isolated from this air flow, FIG. 28.

Figure 28:
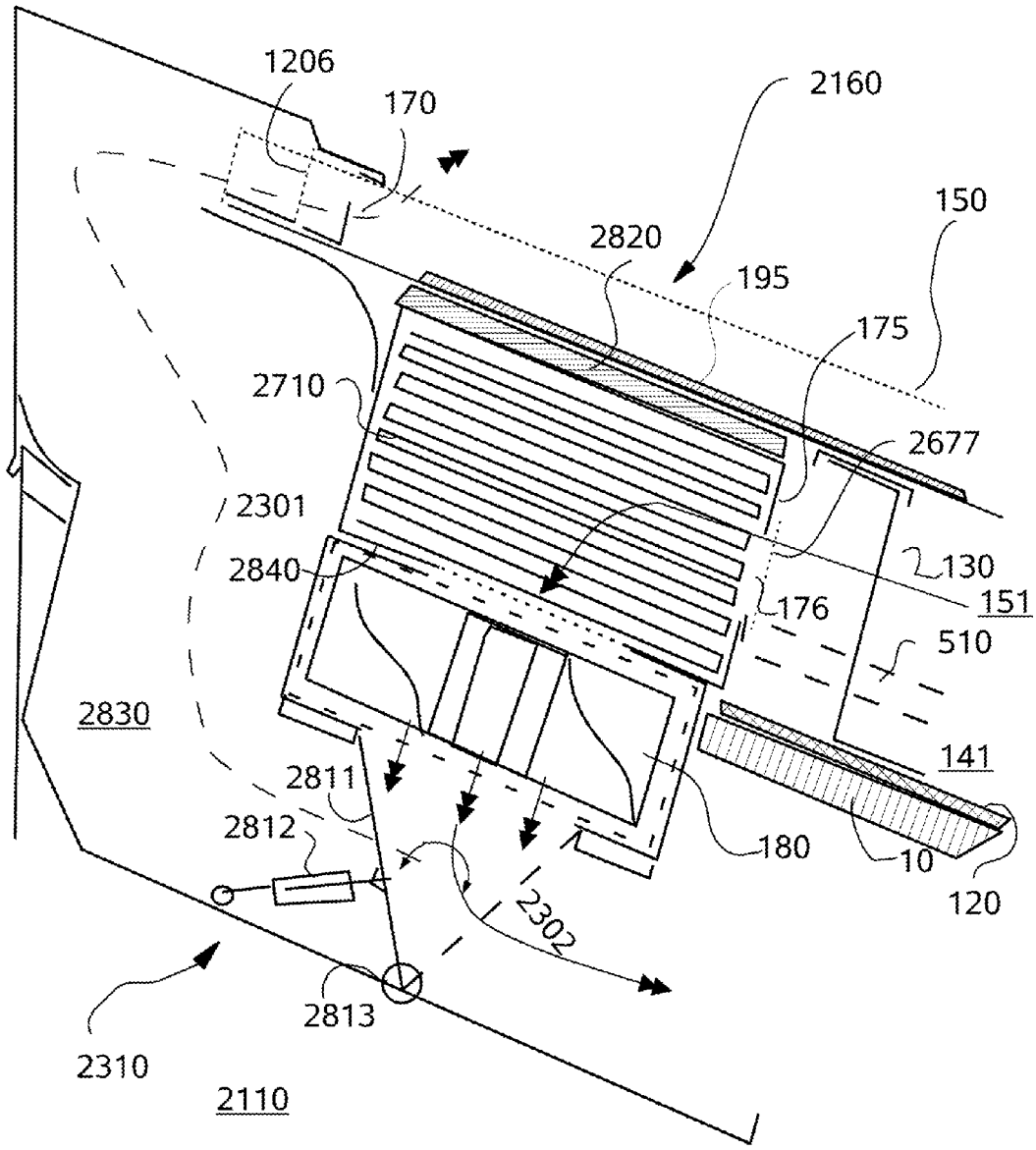
FIG. 28 is a cross-section elevation through components in FIG. 27
Figure 29:
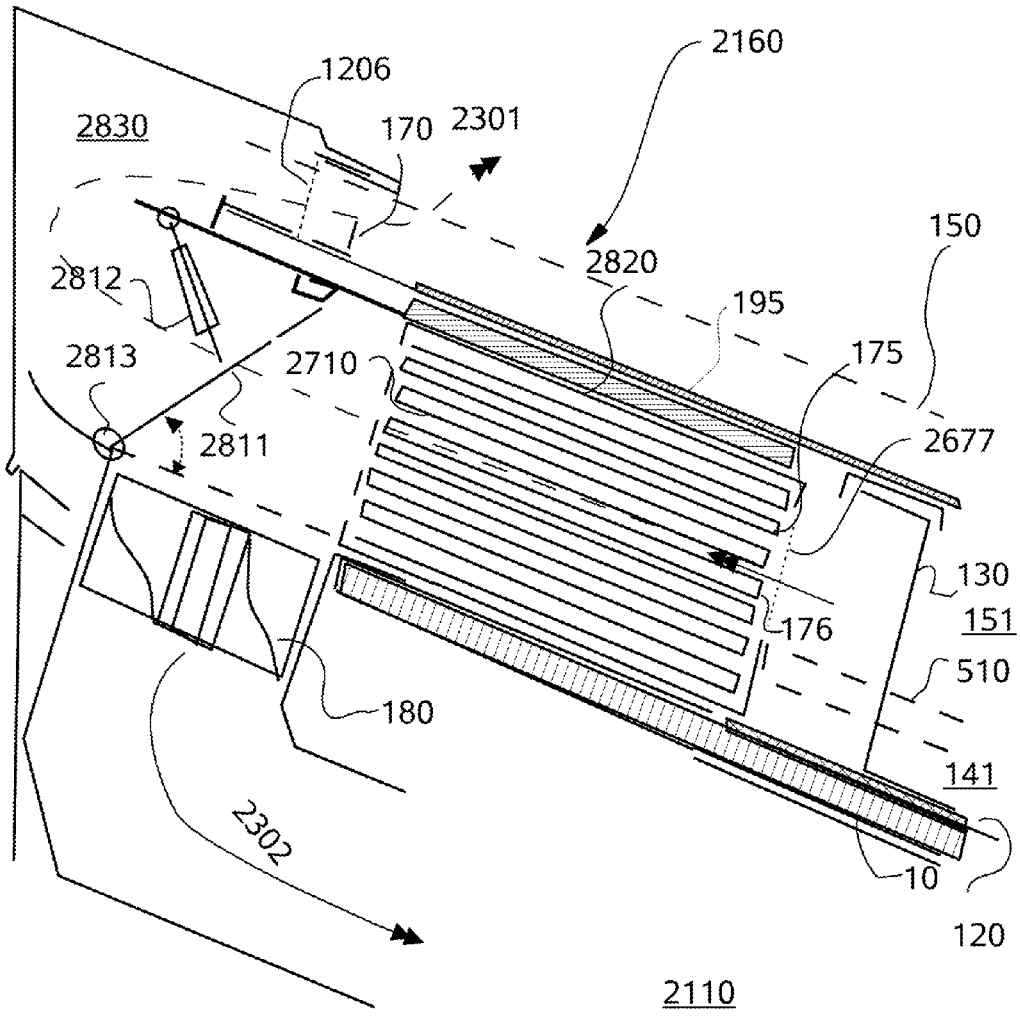
FIG. 29 is a cross-sectional elevation through an alternative to the component shown in FIG. 28.

In FIGS. 28 and 29, a first flow diverting baffle 2310 is disposed below the exhaust fan 180 to direct air flow via either the path of arrow 2301 or arrow 2302. The first flow diverting baffle 2310 has a door 2311 that is disposed below the exit aperture of the housing for fan 180, and is operative via an electric actuator 2812 to swing at hinge 2813 between alternative positions such that the air removed from upper cavity 151 is directed into the attic space 2110 (arrow 2302) or in the alternative mode to an exhaust duct 2830 that directs air from upper cavity 151 to externally vent at exit port 170 outside the structure (arrow 2301). Exhaust duct 2830, which is typically 24 gauge metal, ends at exhaust port or vent 170.

Another screen 2840 is preferably disposed between the electric turbine fan 180 and the exit to duct 2160. In addition, a perforated "Z" shaped member 1206 also acts as a screen just inside of exit aperture 170. A Neoprene™ rubber duct seal 2820 is preferably disposed between duct 2160 and the upper portion of the roof 150.

As discussed with respect to other embodiment and figures, various thermal sensors are deployed to measure the temperature of air within or exiting upper chamber 151 such that the controller 17100 deploys the electric actuator 2812 as appropriate to the season and desired internal temperature. It should also be appreciated that the embodiments of FIG. 28-30 also optionally deploys a PV cell, and more preferably Uni-solar brand self adhered PV cell 195 on the upper layer 150 of the roof.

FIG. 29 is a cross-sectional elevation through an alternative to the component shown in FIG. 27, showing a similar first flow diverting baffle 2310 now disposed to isolate exhaust fan 180 when natural thermal conductive flow is used to expel air from upper cavity 151 via duct 2830. Thus, the duct 2160 directly vents to the outside, with the baffle door 2811 is lowered so that it is disposed between the electric turbine fan 180 and the duct 2160. When the baffle door 2811 is raised to the upward position by actuator 2812, the fan 180 can be activated to draw air from the upper cavity 151 into the attic space 2110. The baffle door is 2811 is pivotable about hinge 2813 upon activation by the controller 17100 to isolate the fan 180, which can then be turned off by the controller, as the fan 180 only needs to operate when it is desirable to vent air form cavity 151 in to the attic space 2110.

Figure 30:
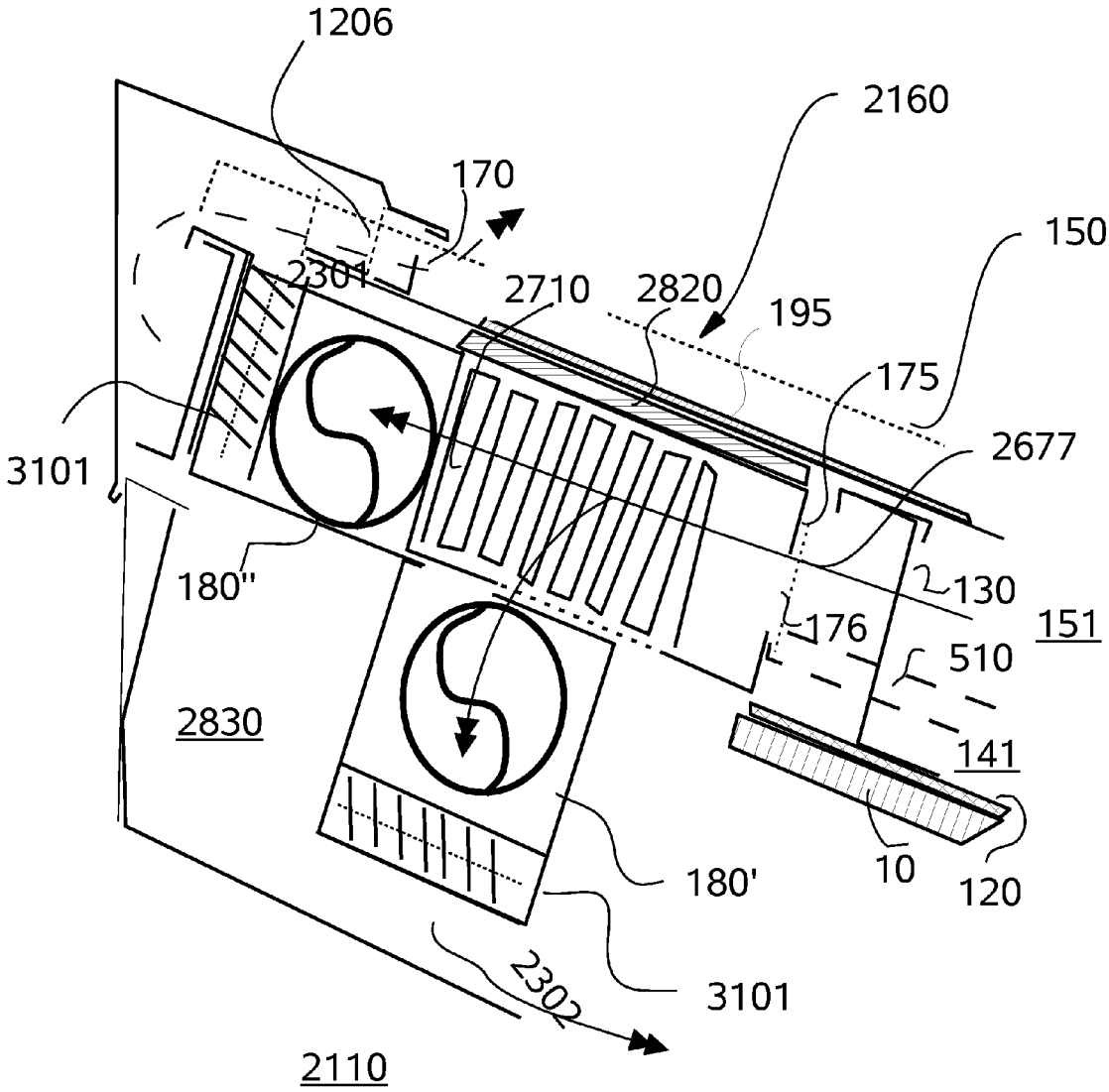
FIG. 30 is a cross-sectional elevation through an alternative to the component shown in FIGS. 28 and 29.

FIG. 30 is another alternative embodiment of the duct and baffle constructions in FIG. 27-29 in which a first 180' and second fan 180" are deployed. A first fan 180' operates to vent air from cavity 151 outside the structure via the exit aperture or portal 170, whereas fan 180" operates to vent air to the attic space 2210. Each of fans 180' and 180" optionally deploys either air directing baffles 3101 and 3102 respectively, or alternatively baffles that switch between a closed and open state.

These fans and baffles are preferably responsive to operation by controller 17100 for the reasons described above. More preferably baffles 3101 and 3102 deploy a series of louvers as shown, which are closed by a coupled spring in the absence of air pressure from the adjacent fan. Thus, the louvers remain closed to prevent air flow through the passage of the fan that is not operating when the opposite fan operates and its associated adjacent louvers open.

Experimental Results

Figure 31:
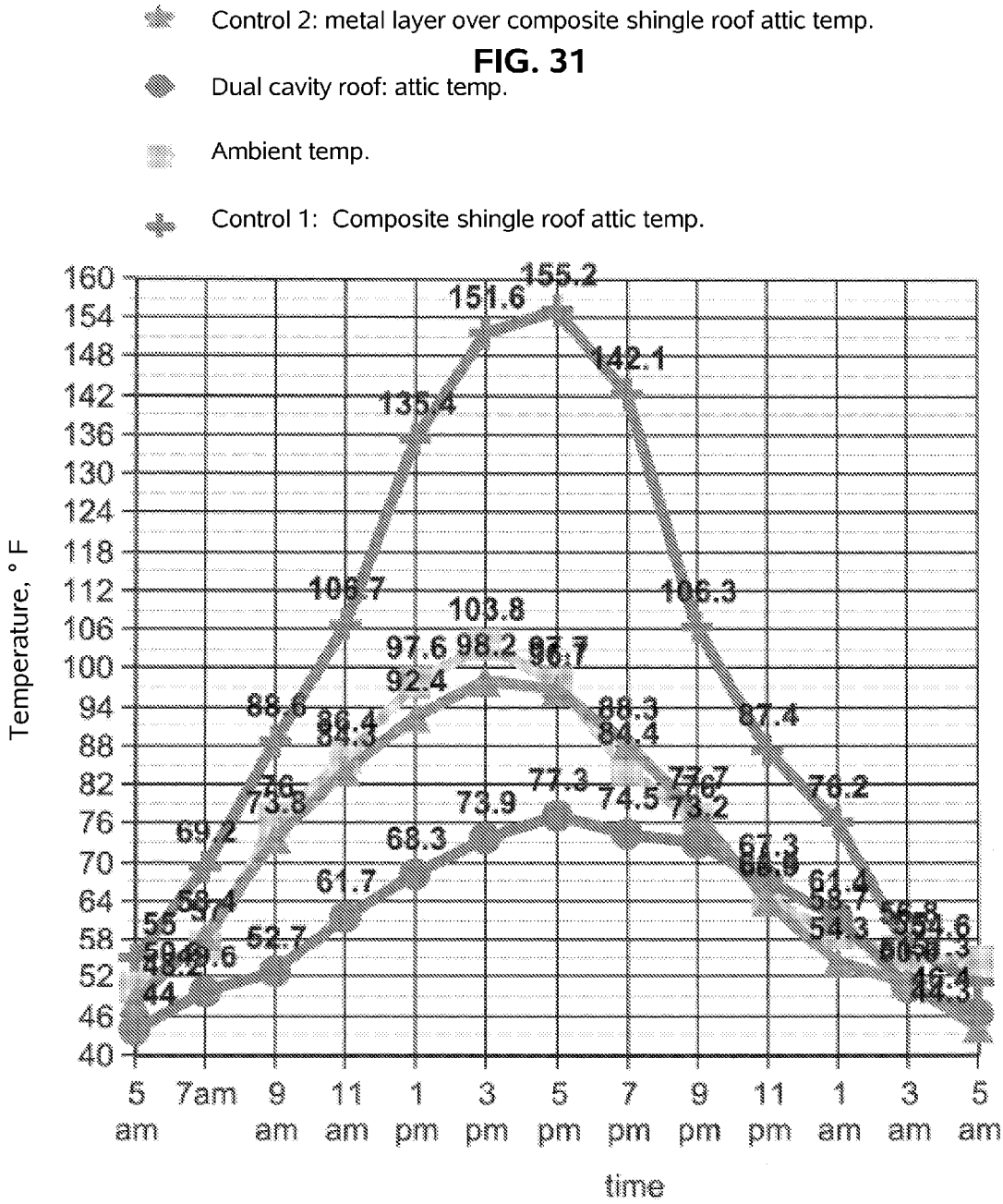
FIG. 31 is a chart comparing the recorded ambient temperature to the temperature in the attic of the dual cavity roof system against a composite shingle roof as a first control and a white metal roof simply placed on a composite shingle roof as a second control.

FIG. 31 is a chart comparing the recorded ambient temperature to the temperature in the attic of a test structure having a dual cavity roof system ("Shield") against an adjacent test structure having a composite shingle roof as a first control ("Control 1") and another adjacent test structure having a white metal roof simply placed on a composite shingle roof as a second control ("Control 2"). Within 2 hours after the ambient temperature reached 104° F., the first control as an attic temperature of about 50° F. hotter (155 F.), the second control performs better, reducing the attic temperature about 5° F. below the peak ambient temperature. However, the dual cavity roof system with ventilation of the upper cavity maintains the attic temperature below the ambient temperature (which is lower at night as discussed above) providing the unexpectedly superior results of never rising above about 77° F.

Figure 32:
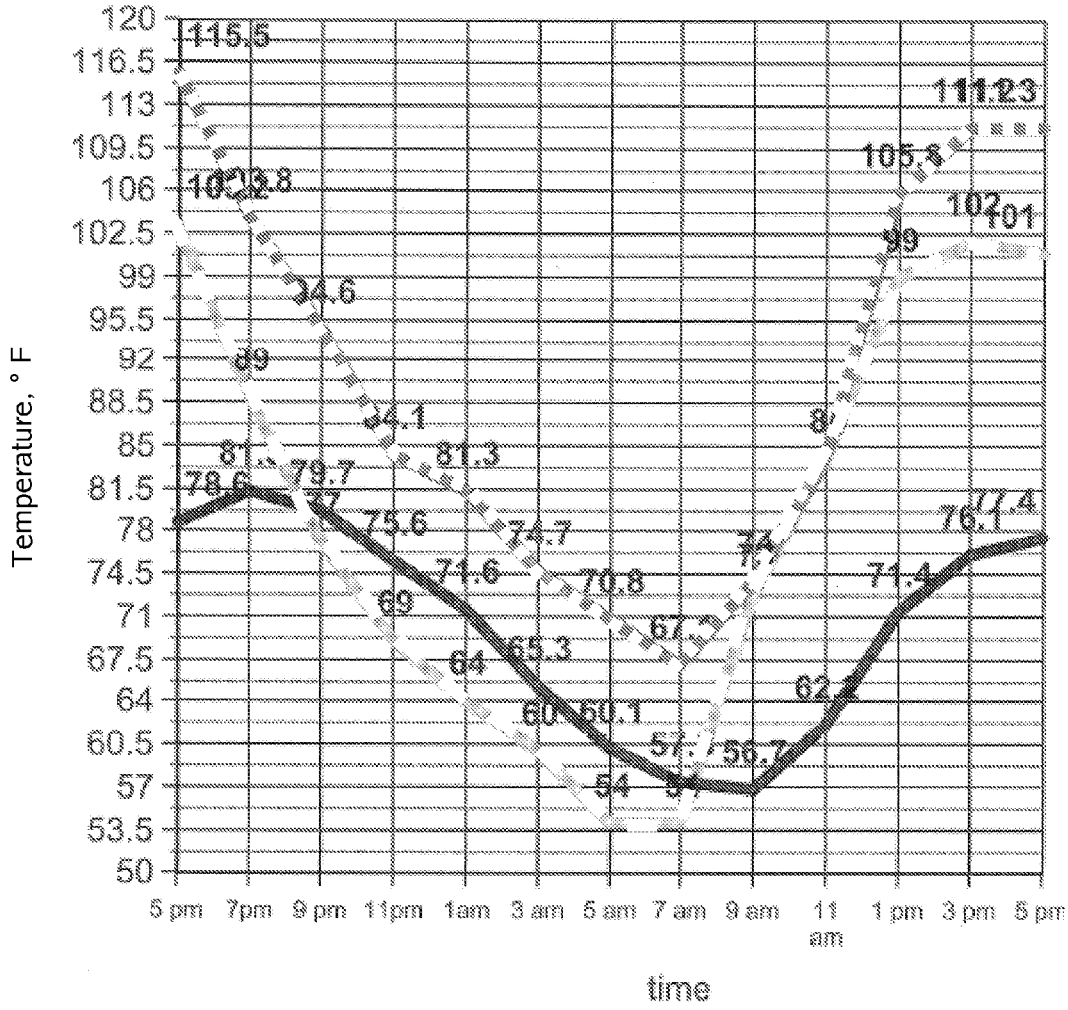
FIG. 32 is a chart comparing the recorded ambient temperature to the interior ceiling temperature for a control structure having a single layer of convention composite shingle roofing against a dual cavity system in which the upper cavity is selectively ventilated at night for summer cooling.

FIG. 32 is a chart comparing the recorded ambient temperature (over a 24 hour period) to the interior ceiling temperature for a control structure having a single layer of conventional composite shingle roofing as well as the inventive dual cavity system in which the upper cavity is selectively ventilated at night for summer cooling. Similarly, the dual cavity system dampens the daytime temperature rise in the ceiling below the attic to somewhat above ambient temperature from about 9 pm to about 7 am, but as the ambient temperature rises steeply after about 7 am, the ceiling temperature is maintained below ambient temperature, never exceeding about 79° F. even when the ambient temperature exceed about 103° F. In contrast, the control composite shingle roof, while also cooling down at night, still results in a ceiling temperature that is always above ambient, and as much as 10° F. over ambient in the afternoon (3-5 pm).

Figure 33:
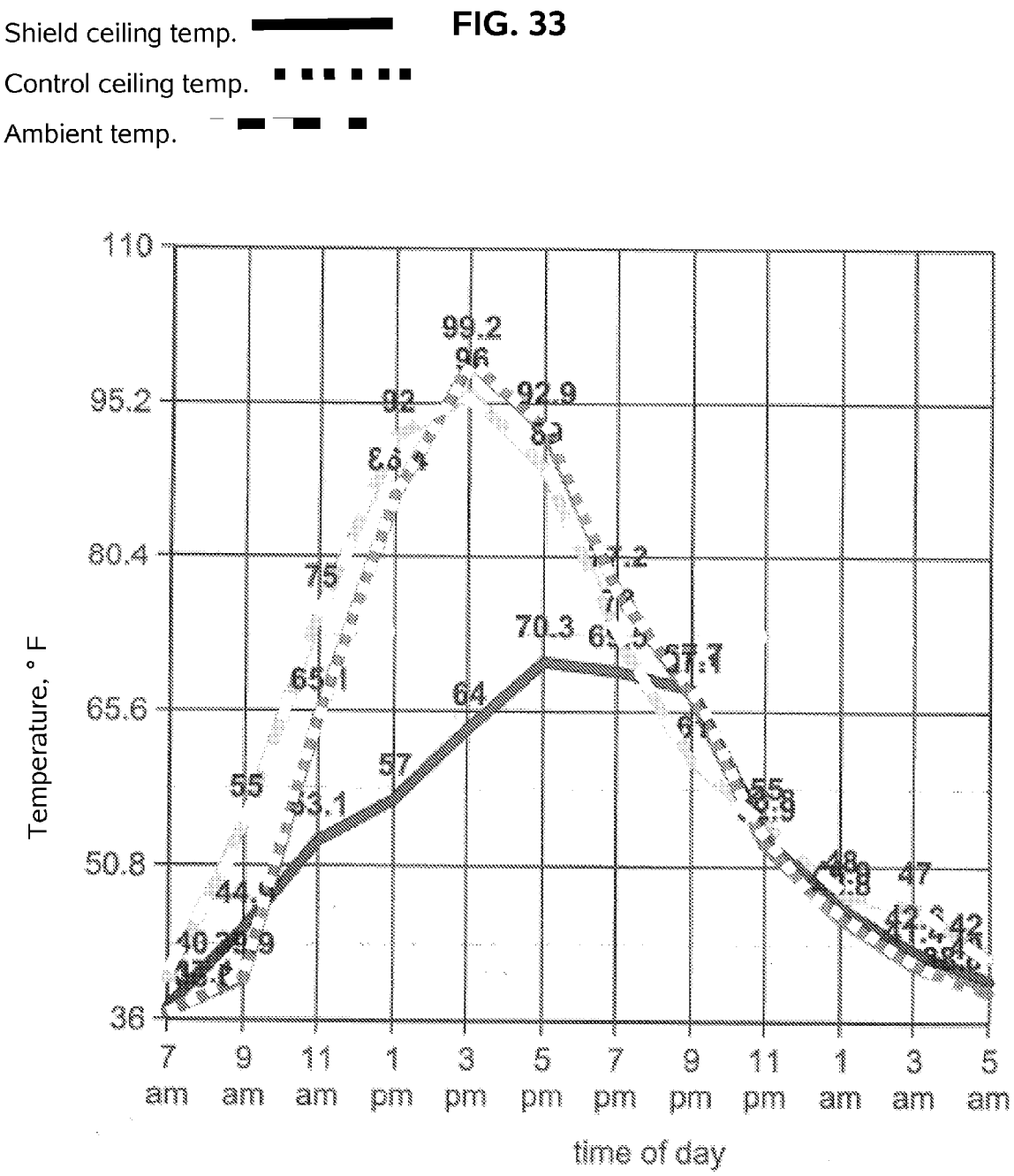
FIG. 33 is a chart comparing the recorded ambient temperature to the interior attic temperature for a control structure having a single layer of metal roofing against a dual cavity system in which the upper cavity is selectively ventilated at night for summer cooling.

FIG. 33 is a chart comparing the recorded ambient temperature to the interior attic temperature for a control structure having a single layer of metal roofing against a dual cavity system in which the upper cavity is selectively ventilated at night for summer cooling. The control roof slightly lags the ambient temperature rise by about an hour, exceeding it by about 4° F. at around 3 pm. In contrast, by venting the upper cavity of the dual cavity roof, the lag time is increased to 2 hours, when compared to the ambient peak temperature, but the attic stays about 20° F. cooler than the ambient temperature. Further, using the benefit of nighttime cooling from 11 pm to 5 am, the attic temperature is below the ambient temperature.

Figure 34:
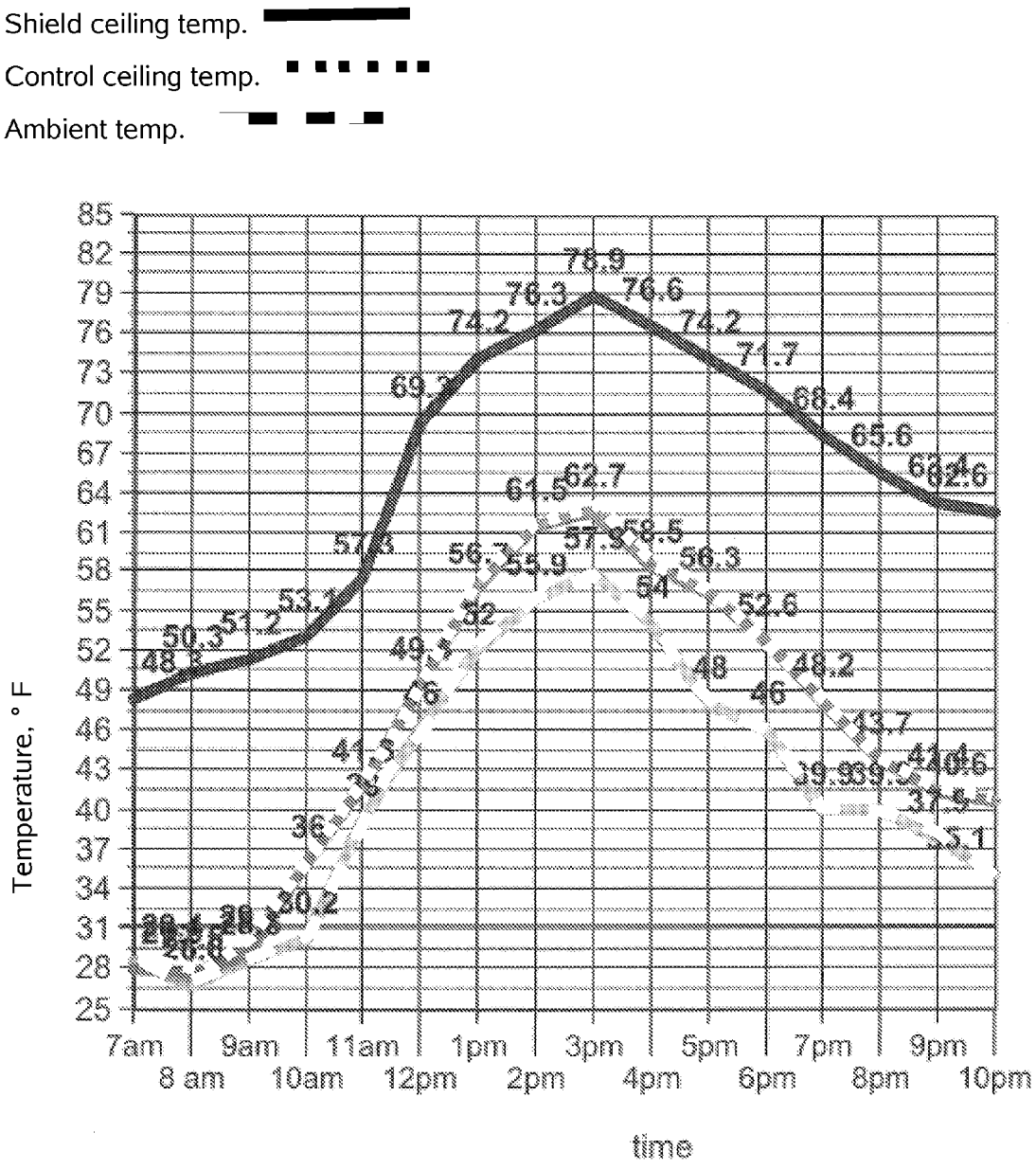
FIG. 34 is a chart comparing the recorded ambient temperature to the temperature in the attic portion for a control structure having a single layer of convention composite shingle roofing against a dual cavity system in which the upper cavity is selectively ventilated for winter heating.

FIG. 34 provides another chart with actual thermal measurements made in a test structure having a dual cavity roof under winter conditions having a metal roof as the outer roofing layer, which is compared with an adjacent test structure having conventional composite shingle over a single outer roof layer. Temperatures were periodically measured within the attic 2110 and compared with the outside ambient temperature from 7 am to 10 pm. The upper cavity is selectively ventilated for winter heating, in which the ambient temperature fluctuated from about 28° F. at night to about 62° F. at about 3 pm. The vented upper cavity system heated the attic air to more than 20° F. above ambient temperatures by 3 pm, while the control structure with a composite shingle roof only heated the attic air to about 5° F. above ambient temperature. More significantly, while the control structure attic temperature clearly tracking the rise and fall of the ambient temperature. However, as the selectively vented dual cavity system, the heat buffer capacity of the attic space preventing the attic air from dropping below about 48° F., maintaining its temperature more than 23° F. above the much colder morning air (26° F.) at about 8 am. Further, the attic air was heated to a comfortable temperature of about 79° F. at 3 pm, which unlike the composite shingle control structure is about 15° F. over the ambient temperature. The control structure only heated the attic air to 5-6° F. over ambient. Hence, by harvesting this significantly warmer attic air during the day and evening, the need for extra energy to warm a structure is vastly reduced.

It should be understood that a most preferred embodiment of the invention would include either a dual or single cavity roof that heats or cools air using ambient conditions, and then optionally stores this air in a internally insulated attic space, but then deploy an air mixing unit having a fan or blower unit filters and de-humidifies the air for further delivery to the climate controlled portion of the structure. Ideally PV cell on the roof can be used to power the optional fans or blowers in the system components, as well as power a controller that is operative to selectively operative valves or baffles that control the circulation of air to or from the single or dual cavity, as well as the mixing unit and return of air from the climate controlled portions of the structure or elsewhere. It should be understood that the description of preferred embodiments with specific components is not intended to limit or preclude the scope of the claims from covering alternative combinations.

Further, structures to be cooled using the various embodiments of the system 100 disclosed herein include, without limitation dwellings as well as commercial buildings, storage sheds, silos, animal shelters, coop and barns, warehouses, tents, garages, sidewall less structures, tents, utility cabinets and portable toilets, even if such structures would not normally be air conditioned.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

We claim:

1. A thermogenic augmentation system disposed on the exterior surface of a building structure, the system comprising:

a) a radiant barrier layer covering at least one exterior surface of the structure, the radiant barrier layer being generally disposed in a first plane that is co-extensive with a planar portion of the structure, b) a plurality of mounting brackets disposed above said radiant barrier that are connected to the exterior surface of the structure, wherein said mounting brackets support;

i) an inner skin spaced away from said radiant barrier layer, being disposed in a second plane substantially parallel to said first plane, ii) an outer skin spaced away from said inner skin, being disposed in a third plane substantially parallel to said first plane and second plane, iii) wherein the region between said radiant barrier layer and the inner skin is a lower cavity, and the region between said inner skin and said outer skin is a ventilated upper cavity, c) one or more air inlet vents disposed in fluid communication with the upper cavity at a lower lateral extent thereof, d) one or more air outlet vents disposed in fluid communication with the upper cavity at an upper lateral extent thereof, e) at least one fan disposed in fluid communication with the upper cavity to expel air that enters via said inlet vents to a climate controlled portion of the structure by;

i) a means to direct air from the upper cavity to the attic space, ii) a means to force the air received in the attic space into a ventilation system of the building structure, and iii) a means for air to return to the attic space of the building structure from the climate controlled portion of the structure that received air from the ventilation system thereof.

2. A thermogenic augmentation system disposed on the exterior surface of a building structure according to claim 1 wherein said at least one fan is further operative to draw air into the upper cavity from said air inlet vents, wherein said air inlets are in at least one of inside the structure and outside the structure.

3. A thermogenic augmentation system disposed on the exterior surface of a building structure according to claim 1 wherein said means to direct air from the upper cavity to the attic space comprises a duct that extends the length of a roof having said upper cavity and said means for air to return to the dwelling is at least one fan.

4. A thermogenic augmentation system disposed on the exterior surface of a building structure according to claim 1 further comprising a plurality of heat transfer coils disposed within said duct.

5. A thermogenic augmentation system disposed on the exterior surface of a building structure according to claim 4 and further comprising a baffle means that is operative to selectively expel air from the duct after passing over said heat transfer coils and before entering said attic space.

6. A thermogenic augmentation system disposed on the exterior surface of a building structure according to claim 5 wherein said baffle means are disposed between said duct and said fan such that hot air can escape and be directed upward without entering the air space when said fan is not operating.

7. A thermogenic augmentation system disposed on the exterior surface of a building structure according to claim 1 wherein said fan is disposed in fluid communication with the center of the duct and said heat transfer coils are subdivided into 2 pairs disposed on opposing sides of said fan.

8. A thermogenic augmentation system disposed on the exterior surface of a building structure according to claim 1 and further comprising an air mixing unit having an intake fan means that is disposed in the attic and is in fluid communication with the attic air space to collect air inserted therein for return to the climate controlled portion of the structure via a primary ventilation duct, the primary ventilation duct being in fluid communication with at least one of an air conditioner and a forced air heater.

9. A thermogenic augmentation system disposed on the exterior surface of a building structure according to claim 8 and further comprising an adjustable baffle means to isolate the at least one of an air conditioner and forced air heater when the intake fan means of the air mixing unit is operative to force air from the attic space into the dwelling via a primary ventilation duct.

10. A thermogenic augmentation system disposed on the exterior surface of a building structure according to claim 8 wherein said an air mixing unit further comprises a filter and de-humidifier.

11. A thermogenic augmentation system disposed on the exterior surface of a building structure according to claim 1 wherein said lower cavity is sealed.

12. A thermogenic augmentation system disposed on the exterior surface of a building structure, the system comprising:

a) a radiant barrier layer covering at least one exterior surface of the structure, the radiant barrier layer being generally disposed in a first plane that is co-extensive with a planar portion of the structure, b) a plurality of mounting brackets disposed above said radiant barrier that are connected to the exterior surface of the structure, wherein said mounting brackets support;

i) an outer skin spaced away from said radiant barrier layer, being disposed in a second plane substantially parallel to said first plane to form an outer cavity, c) one or more air inlet vents disposed in fluid communication with the outer cavity at a lower lateral extent thereof, d) one or more air outlet vents disposed in fluid communication with the outer cavity at a upper lateral extent thereof, e) at least one fan disposed in fluid communication with the outer cavity to draw air in from said air inlet vents and selectively expel the air is to at least any two of an attic, a ventilation system of the structure and external to the structure, (f) an air mixing unit having an intake fan means that is disposed in the attic and is in fluid communication with the attic air space to collect air inserted therein for return to a climate controlled portion of the structure via a primary ventilation duct, the primary ventilation duct being in fluid communication with at least one of an air conditioner and a forced air heater.

13. A thermogenic augmentation system according to claim 12 further comprising a plurality of PV cells disposed on the outer surface of the structure to receive solar radiation and connected provide power to said at least one fan.

14. A thermogenic augmentation system according to claim 12 and further comprising a plurality of thermal sensors disposed to measure and compare the temperatures in at least a portion of the two or more of the attic, the outer cavity, and a region external to the structure.

15. A thermogenic augmentation system according to claim 14 further comprising a controller that is operative to modulate the operation of the said at least one fan in response to value of the compared temperatures from at least a portion of the two or more of the attic, the outer cavity, and a region external to the structure.

16. A thermogenic augmentation system according to claim 12 wherein the outer skin is the roof of the structure.

17. A thermogenic augmentation system disposed on the exterior surface of a building structure, the system comprising:

a) a radiant barrier layer covering at least one exterior surface of the structure, the radiant barrier layer being generally disposed in a first plane that is co-extensive with a planar portion of the structure, b) a plurality of mounting brackets disposed above said radiant barrier that are connected to the exterior surface of the structure, wherein said mounting brackets support, i) an outer skin spaced away from said radiant barrier layer, being disposed in a second plane substantially parallel to said first plane to form an outer cavity, c) one or more air inlet vents disposed in fluid communication with the outer cavity at a lower lateral extent thereof, d) one or more air outlet vents disposed in fluid communication with the outer cavity at a upper lateral extent thereof, e) at least one fan disposed in fluid communication with the outer cavity to draw air in from said air inlet vents and selectively expel the air is to at least one of an attic, a ventilation system of the structure and external to the structure, f) a common duct in fluid communication with the outer cavity that extends along the upper lateral extent thereof and is disposed below the roof of the structure, g) a baffle disposed to laterally extend between said common duct and a corresponding upper lateral extent of the outer cavity, h) wherein said baffle has a plurality of apertures along the length thereof to provide substantially uniform air flow across the lateral extent of the upper cavity in the direction of said common duct.

18. A thermogenic augmentation system disposed on the exterior surface of a building structure according to claim 17 further comprising at least one heat transfer coil disposed within said duct.

19. A thermogenic augmentation system disposed on the exterior surface of a building structure the system comprising:

a) a radiant barrier layer covering at least one exterior surface of the structure, the radiant barrier layer being generally disposed in a first plane that is co-extensive with a planar portion of the structure, b) a plurality of mounting brackets disposed above said radiant barrier that are connected to the exterior surface of the structure, wherein said mounting brackets support, i) an outer skin spaced away from said radiant barrier layer, being disposed in a second plane substantially parallel to said first plane to form an outer cavity, c) one or more air inlet vents disposed in fluid communication with the outer cavity at a lower lateral extent thereof, d) one or more air outlet vents disposed in fluid communication with the outer cavity at a upper lateral extent thereof, e) at least one fan disposed in fluid communication with the outer cavity to draw air in from said air inlet vents and selectively expel the air is to at least any two of an attic, a ventilation system of the structure and external to the structure, f) a common duct in fluid communication with the outer cavity that extends along the upper lateral extent thereof and is disposed below the roof of the structure, g) at least one heat transfer coil disposed within said duct, wherein said fan is disposed in fluid communication with the center of the duct and said heat transfer coils are subdivided into 2 pairs disposed on opposing sides of said fan.

20. A thermogenic augmentation system disposed on the exterior surface of a building structure according to claim 19 and further comprising a baffle means that is operative to selectively expel air from the duct after passing over said heat transfer coils and before entering said attic space.

* * * * *